US008594829B2

(12) United States Patent
Tokura

(10) Patent No.: US 8,594,829 B2
(45) Date of Patent: Nov. 26, 2013

(54) SEWING MACHINE AND COMPUTER PROGRAM PRODUCT STORED ON NON-TRANSITORY COMPUTER-READABLE MEDIUM

(75) Inventor: Masashi Tokura, Konan (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 187 days.

(21) Appl. No.: 13/351,606

(22) Filed: Jan. 17, 2012

(65) Prior Publication Data

US 2012/0191237 A1 Jul. 26, 2012

(30) Foreign Application Priority Data

Jan. 20, 2011 (JP) ..... 2011-009709
Feb. 28, 2011 (JP) ..... 2011-043327
Sep. 27, 2011 (JP) ..... 2011-211315

(51) Int. Cl.
*G06F 7/66* (2006.01)

(52) U.S. Cl.
USPC ..... 700/136; 112/102.5; 112/470.01; 112/475.02

(58) Field of Classification Search
USPC ..... 700/136–138; 112/102.5, 103, 470.01, 112/470.03, 470.04, 470.06, 475.02, 112/475.18, 475.19
See application file for complete search history.

(56) References Cited

U.S. PATENT DOCUMENTS 4,876,976 A * 10/1989 Brower et al. ..... 112/475.05
4,998,489 A * 3/1991 Hisatake et al. ..... 112/103
5,151,863 A 9/1992 Komuro et al.
5,283,747 A 2/1994 Komuro et al.
5,553,559 A * 9/1996 Inoue et al. ..... 112/102.5
5,855,176 A * 1/1999 Takenoya et al. ..... 112/102.5
5,911,182 A * 6/1999 Uyama et al. ..... 112/102.5
6,000,350 A * 12/1999 Koike et al. ..... 112/102.5
6,158,366 A * 12/2000 Codos ..... 112/475.19
6,167,822 B1 1/2001 Miyasako et al.
6,324,441 B1 11/2001 Yamada (Continued)

FOREIGN PATENT DOCUMENTS

JP A-06-339588 12/1994
JP A-10-137467 5/1998

(Continued)

OTHER PUBLICATIONS

Jun. 26, 2013 Office Action issued in U.S. Appl. No. 13/453,625.

(Continued)

*Primary Examiner* — Nathan Durham
(74) *Attorney, Agent, or Firm* — Oliff & Berridge, PLC

(57) ABSTRACT

A sewing machine includes an image capturing device capturing a marker on a sewing target object; a layout determination portion determining a relative layout of the next pattern, if a reference pattern is a pattern that is sewn when a holding position of the sewing target object is a first holding position and a next pattern is a pattern that is sewn subsequently to the reference pattern and that is sewn when the holding position is a second holding position; a layout detection portion detecting a layout of the marker; a registration portion registering information as storage information relating to the layout of the marker; an update portion updating the storage information when the layout of the marker is newly detected; and a setting portion setting a layout of the next pattern when the storage information relating to the marker captured in the second holding position.

16 Claims, 25 Drawing Sheets

(56) References Cited

U.S. PATENT DOCUMENTS

| | | | | |
|---|---|---|---|---|
| 7,155,302 | B2 * | 12/2006 | Muto et al. | 700/138 |
| 7,702,415 | B2 * | 4/2010 | Roos | 700/138 |
| 8,061,286 | B2 | 11/2011 | Hirata et al. | |
| 8,090,466 | B2 | 1/2012 | Yamada | |
| 8,200,357 | B2 | 6/2012 | Yamada | |
| 8,463,420 | B2 | 6/2013 | Tokura | |
| 2006/0096510 | A1 * | 5/2006 | Kuki et al. | 112/102.5 |
| 2010/0242817 | A1 | 9/2010 | Tokura | |
| 2011/0048301 | A1 | 3/2011 | Tokura | |

FOREIGN PATENT DOCUMENTS

| | | |
|---|---|---|
| JP | A-2005-073866 | 3/2005 |
| JP | A-2010-246885 | 11/2010 |
| JP | A-2011-050635 | 3/2011 |

OTHER PUBLICATIONS

U.S. Appl. No. 13/453,625, filed Apr. 23, 2012 in the name of Masashi Tokura.

* cited by examiner

SEWING MACHINE AND COMPUTER PROGRAM PRODUCT STORED ON NON-TRANSITORY COMPUTER-READABLE MEDIUM

CROSS-REFERENCE TO RELATED APPLICATION

This application claims priority from JP2011-009709, filed on Jan. 20, 2011, JP2011-043327, filed on Feb. 28, 2011 and JP2011-211315, filed on Sep. 27, 2011, the content of which is hereby incorporated by reference.

BACKGROUND

The present disclosure relates to a sewing machine provided with an image capturing device, and to a computer program product.

Conventionally, a sewing machine is known that is provided with an image capturing device and that can sew a pattern that is larger than a sewable area that is set inside an embroidery frame. For example, when a large pattern is divided into a plurality of pieces to be sewn, the sewing machine divides the pattern that is larger than the sewable area into a plurality of patterns that are smaller than the sewable area. Then, in accordance with divided sewing data, the sewing machine sequentially sews the divided patterns based on conditions in which holding positions of a sewing target object with respect to the embroidery frame are different. The above-described known sewing machine automatically performs positioning between the divided patterns based on the conditions in which the holding positions of the sewing target object are different, based on markers arranged on a surface of the sewing target object.

SUMMARY

In the known sewing machine, a case is not considered in which a plurality of patterns that are freely selected by a user are sewn in a range that is larger than the sewable area. Therefore, when a plurality of patterns are sewn in a range that is larger than the sewable area, it is difficult to set a position of a next pattern to be sewn next, with respect to a position of a reference pattern that is sewn first.

The present disclosure has been made to solve the above-described problem, and provides a sewing machine and a computer program product that are capable of easily setting a layout of a next pattern with respect to a reference pattern when a plurality of patterns are sewn in a range that is larger than a sewable area.

Embodiments provide a sewing machine that includes an image capturing device that captures a marker arranged on a surface of a sewing target object held by an embroidery frame, an acquisition portion that acquires image data of the marker captured by the image capturing device, a layout determination portion that, if it is assumed that a reference pattern is a pattern that is sewn when a holding position of the sewing target object with respect to the embroidery frame is a first holding position and it is also assumed that a next pattern is a pattern that is sewn subsequently to the reference pattern and that is sewn when the holding position is a second holding position that is different from the first holding position, determines a relative layout including at least one of a position and an angle of the next pattern with respect to a layout including at least one of a position and an angle of the reference pattern, a layout detection portion that, based on the image data acquired by the acquisition portion, detects a layout including at least one of a position and an angle of the marker with respect to the layout of the reference pattern, a storage device that stores the layout of the marker as layout information, a registration portion that registers, in the storage device, information relating to the layout including at least one of the position and the angle of the marker with respect to the layout of the reference pattern that is detected by the layout detection portion, the information being registered as storage information, an update portion that updates the storage information stored in the storage device when the layout including at least one of the position and the angle of the marker with respect to the layout of the reference pattern is newly detected by the layout detection portion, and a setting portion that, when the storage information stored in the storage device is information relating to the marker captured in the second holding position, sets a layout including at least one of a position and an angle of the next pattern with respect to the sewing target object in the second holding position, based on the storage information and on the relative layout of the next pattern with respect to the layout of the reference pattern that is determined by the layout determination portion.

Embodiments also provide a computer program product stored on a non-transitory computer-readable medium, comprising instructions for causing a computer of a sewing machine to execute the steps of capturing a marker arranged on a surface of a sewing target object held by an embroidery frame, acquiring image data of the captured marker, determining, if it is assumed that a reference pattern is a pattern that is sewn when a holding position of the sewing target object with respect to the embroidery frame is a first holding position and it is also assumed that a next pattern is a pattern that is sewn subsequently to the reference pattern and that is sewn when the holding position is a second holding position that is different from the first holding position, a relative layout including at least one of a position and an angle of the next pattern with respect to a layout including at least one of a position and an angle of the reference pattern, detecting, based on the acquired image data, a layout including at least one of a position and an angle of the marker with respect to the layout of the reference pattern, storing, as storage information, information relating to the detected layout including at least one of the position and the angle of the marker with respect to the layout of the reference pattern, updating the stored storage information when the layout including at least one of the position and the angle of the marker with respect to the layout of the reference pattern is newly detected, and setting, when the stored storage information is information relating to the marker captured in the second holding position, a layout including at least one of a position and an angle of the next pattern with respect to the sewing target object in the second holding position, based on the storage information and on the determined relative layout of the next pattern with respect to the layout of the reference pattern.

BRIEF DESCRIPTION OF THE DRAWINGS

Exemplary embodiments of the invention will be described below in detail with reference to the accompanying drawings in which.

DETAILED DESCRIPTION OF THE EXEMPLARY EMBODIMENTS

Hereinafter, multi-needle sewing machines 1 (hereinafter referred to as "sewing machines 1") according to first and second embodiments of the present disclosure will be explained in order with reference to the drawings.

A physical configuration that is common to the sewing machines 1 according to the first and second embodiments will be explained with reference to FIG. 1 and FIG. 2. In the explanation below, the lower left side, the upper right side, the upper left side and the lower right side of FIG. 1 respectively correspond to the front, the rear, the left side and the right side of the sewing machine 1.

Figure 1:
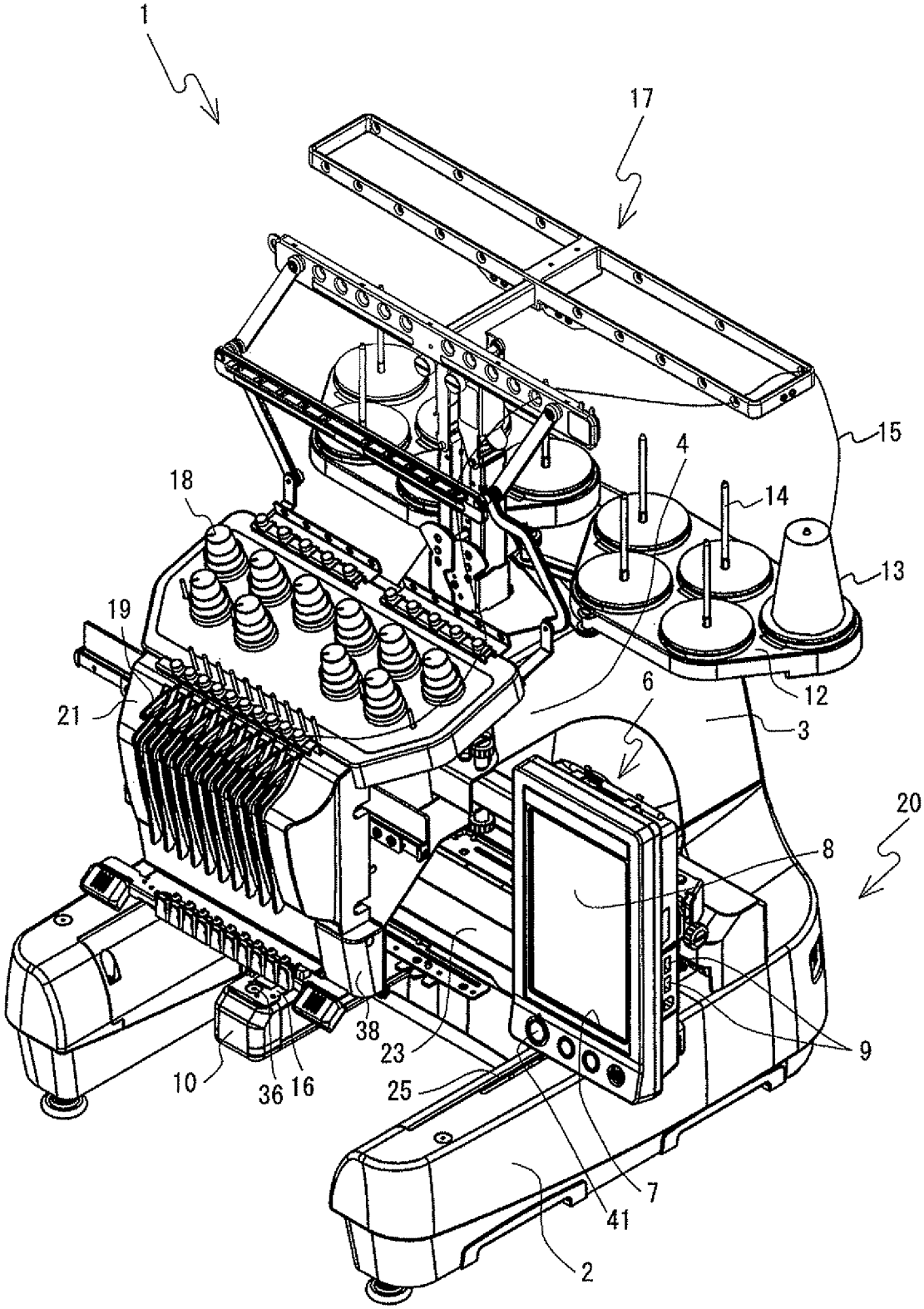
FIG. 1 is a perspective view of a multi-needle sewing machine 1.

As shown in FIG. 1, a main body 20 of the sewing machine 1 is provided with a support portion 2, a pillar 3 and an arm portion 4. The support portion 2 is formed in an inverted U-shape in a plan view, and supports the whole of the sewing machine 1. A pair of left and right guide grooves 25, which extend in a front-rear direction, are provided in an upper surface of the support portion 2. The pillar 3 is provided so as to extend upward from a rear end portion of the support portion 2. The arm portion 4 extends to the front from an upper end portion of the pillar 3. A needle bar case 21 is attached to the tip end of the arm portion 4 such that the needle bar case 21 can move in a left-right direction. Ten needle bars 31 (refer to FIG. 3), which extend in an up-down direction, are disposed inside the needle bar case 21 at an equal interval W in the left-right direction. A needle number is assigned to each of the needle bars 31 in order to identify each of the needle bars 31. In the present embodiment, needle numbers 1 to 10 are assigned in order from the right side of the sewing machine 1. Of the ten needle bars 31, the needle bar 31 that is in a sewing position is caused to move in the up-down direction by a needle bar drive mechanism 32 (refer to FIG. 3) that is provided inside the needle bar case 21. A needle 35 (refer to FIG. 3) is detachably attached to the lower end of each of the needle bars 31.

A cover 38 is provided on a lower portion of a right side surface of the needle bar case 21. An image sensor holding mechanism (not shown in the drawings) is attached to the inner side of the cover 38. The image sensor holding mechanism is provided with an image sensor 50 (refer to FIG. 3). The image sensor 50 is a known complementary metal oxide semiconductor (CMOS) image sensor. A lens (not shown in the drawings) of the image sensor 50 is directed below the sewing machine 1. The center of the lens is located at a position separated from the needle bar 31 on the right most side, by a distance 2W.

An operation portion 6 is provided on the right side of a central portion in the front-rear direction of the arm portion 4. The operation portion 6 is supported by the arm portion 4 such that the operation portion 6 can rotate around a shaft extending in the up-down direction (not shown in the drawings), which serves as an axis of rotation. The operation portion 6 is provided with a liquid crystal display (LCD) 7, a touch panel 8, a connector 9, and a start/stop switch 41. Various types of information, such as operation images used by a user to input a command, are displayed on the LCD 7. The touch panel 8 is used to receive a command from the user. The user can select or set various types of conditions, such as a sewing pattern and a sewing condition, by performing a pressing operation, using a finger or a touch pen, on sections of the touch panel 8 that correspond to positions of input keys etc. displayed on the LCD 7. The pressing operation on a certain section of the touch panel 8 that is performed by the user using a finger or a touch pen is hereinafter referred to as a "panel operation". The connector 9 is a USB standard connector and can be connected to a USB device 160 (refer to FIG. 3). The start/stop switch 41 is used to issue a command to start or stop sewing. Sewing is started if the start/stop switch 41 is depressed when sewing is stopped. Sewing is stopped if the start/stop switch 41 is depressed when sewing is being performed.

A cylinder-shaped cylinder bed 10, which extends to the front from a lower end portion of the pillar 3, is provided below the arm portion 4. A shuttle (not shown in the drawings) is provided inside a leading end portion of the cylinder bed 10. The shuttle houses a bobbin (not shown in the drawings) on which a bobbin thread (not shown in the drawings) is wound. A shuttle drive mechanism (not shown in the drawings) is provided inside the cylinder bed 10. The shuttle drive mechanism (not shown in the drawings) rotatably drives the shuttle. A needle plate 16, having a rectangular shape in a plan view, is provided on an upper surface of the cylinder bed 10. The needle plate 16 is provided with a needle hole 36 through which the needle 35 (refer to FIG. 3) passes.

A pair of left and right thread spool bases 12 are provided on a back surface side of an upper surface of the arm portion 4. Five thread spool pins 14 are provided on each of the thread spool bases 12. The thread spool pins 14 extend in the up-down direction. The thread spool pins 14 support thread spools 13. The number of the thread spools 13 that can be mounted on the pair of the thread spool bases 12 is ten, which is the same as the number of the needle bars 31. A needle thread 15 is supplied from one of the thread spools 13 mounted on the thread spool bases 12. The needle thread 15 is supplied, via a thread passage, to a needle hole (not shown in the drawings) of each of the needles 35 that is attached to the lower end of each of the needle bars 31. The thread passage includes a thread guide 17, a tensioner 18, a thread take-up lever 19 and a needle bar thread guard (not shown in the drawings).

A Y carriage 23 of the embroidery frame movement mechanism ills provided below the arm portion 4. The embroidery frame movement mechanism 11 detachably supports an embroidery frame 84 (refer to FIG. 2). The embroidery frame 84 holds a sewing target object 39. The embroidery frame movement mechanism 11 uses an X-axis motor 132 (refer to FIG. 3) and a Y-axis motor 134 (refer to FIG. 3) as driving sources, and thereby causes the embroidery frame 84 to move back and forth and left and right.

The embroidery frame 84 and the embroidery frame movement mechanism 11 will be explained with reference to FIG. 2. The embroidery frame 84 is provided with an outer frame 81, an inner frame 82 and a pair of left and right coupling portions 89. The outer frame 81 and the inner frame 82 of the embroidery frame 84 clamp the sewing target object 39. The coupling portions 89 are plate members having a rectangular shape in a plan view, and their central portions are cut out in a rectangular shape. One of the coupling portions 89 is fixed to a right portion of the inner frame 82 by screws 95 while the other of the coupling portions 89 is fixed to a left portion of the inner frame 82 by screws 94. In addition to the embroidery frame 84, a plurality of types of embroidery frames that are different in size and shape can be mounted on the sewing machine 1. The embroidery frame 84 has a width in the left-right direction (i.e., a distance between the left and right coupling portions 89) that is largest among the embroidery frames that are used for the sewing machine 1. A sewable area is automatically set to a position on the inner side of the inner frame in accordance with a type of the embroidery frame, based on an output signal of a known detector that is not shown in the drawings.

The embroidery frame movement mechanism 11 is provided with a holder 24, an X carriage 22, an X-axis drive mechanism (not shown in the drawings), a Y carriage 23 and a Y-axis movement mechanism (not shown in the drawings). The holder 24 detachably supports the embroidery frame 84. The holder 24 is provided with a mounting portion 91, a right arm portion 92, and a left arm portion 93. The mounting portion 91 is a plate member having a rectangular shape in a plan view, and it is longer in the left-right direction. The right arm portion 92 is a plate member extending in the front-rear direction, and it is fixed to the right end of the mounting portion 91. The left arm portion 93 is a plate member extending in the front-rear direction. The left arm portion 93 is fixed to a left portion of the mounting portion 91 such that the position in the left-right direction with respect to the mounting portion 91 can be adjusted. The right arm portion 92 is engaged with the one of the coupling portions 89 while the left arm portion 93 is engaged with the other of the coupling portions 89.

The X carriage 22 is a plate member and is longer in the left-right direction. A part of the X carriage 22 protrudes toward the front from the front face of the Y carriage 23. The mounting portion 91 of the holder 24 is attached to the X carriage 22. The X-axis drive mechanism (not shown in the drawings) is provided with a linear movement mechanism (not shown in the drawings). The linear movement mechanism is provided with a timing pulley (not shown in the drawings) and a timing belt (not shown in the drawings). The linear movement mechanism causes the X carriage 22 to move in the left-right direction (in the X-axis direction) using the X-axis motor 132 as a driving source.

The Y carriage 23 has a box shape and is longer in the left-right direction. The Y carriage 23 supports the X carriage 22 such that the X carriage 22 can move in the left-right direction. The Y-axis movement mechanism (not shown in the drawings) is provided with a pair of left and right movable objects (not shown in the drawings) and a linear movement mechanism (not shown in the drawings). The movable objects are connected to lower portions of the left and right ends of the Y carriage 23, and vertically pass through the guide grooves 25 (refer to FIG. 1). The linear movement mechanism is provided with a timing pulley (not shown in the drawings) and a timing belt (not shown in the drawings). The linear movement mechanism causes the movable objects to move in the front-rear direction (in the Y-axis direction) along the guide grooves 25, using the Y-axis motor 134 as a driving source. The Y carriage 23 connected to the movable objects, and the X carriage 22 supported by the Y carriage 23 move in the front-rear direction (in the Y-axis direction) in accordance with movement of the movable objects. When the embroidery frame 84 that holds the sewing target object 39 is attached to the X carriage 22, the sewing target object 39 is disposed between the needle bars 31 and the needle plate 16.

Figure 3:
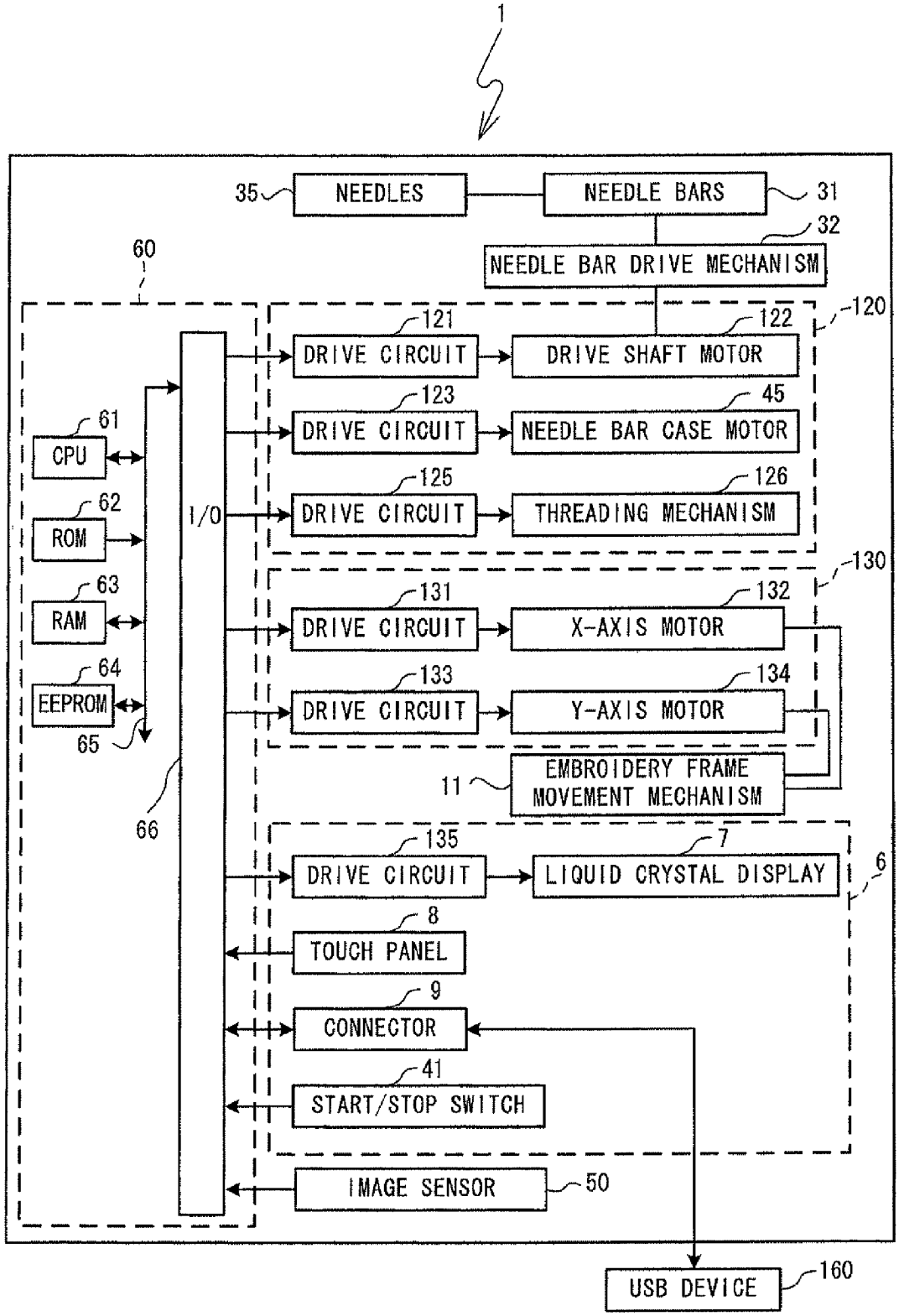
FIG. 3 is a block diagram showing an electrical configuration of the multi-needle sewing machine 1.

An electrical configuration of the sewing machine 1 that is common to the sewing machines 1 according to the first and second embodiments will be explained with reference to FIG. 3. The sewing machine 1 is provided with a needle drive portion 120, a sewing target drive portion 130, the operation portion 6, a control portion 60, and the image sensor 50.

The needle drive portion 120 is provided with drive circuits 121, 123, and 125, a drive shaft motor 122, a needle bar case motor 45, and a threading mechanism 126. The drive shaft motor 122 drives the needle bar drive mechanism 32 and causes the needle bar 31 to reciprocate in the up-down direction. The drive circuit 121 drives the drive shaft motor 122 in accordance with a control signal from the control portion 60. The needle bar case motor 45 causes the needle bar case 21 to move in the left-right direction. The drive circuit 123 drives the needle, bar case motor 45 in accordance with a control signal from the control portion 60. Although not shown in detail in the drawings, the threading mechanism 126 is provided below the front end of the arm portion 4. The threading mechanism 126 is used when the needle thread 15 (refer to FIG. 1) is inserted into the needle hole (not shown in the drawings) of the needle 35 of the needle bar 31 (sewing needle bar) that is located just above the needle hole 36. For example, Japanese Laid-Open Patent Publication No. 2005-73866 discloses the threading mechanism, the relevant portions of which are incorporated by reference. The drive circuit 125 drives the threading mechanism 126 in accordance with a control signal from the control portion 60.

The sewing target drive portion 130 is provided with drive circuits 131 and 133, the X-axis motor 132, and the Y-axis motor 134. The X-axis motor 132 drives the embroidery frame movement mechanism 11 and thereby causes the embroidery frame 84 (refer to FIG. 2) to move in the left-right direction. The drive circuit 131 drives the X-axis motor 132 in accordance with a control signal from the control portion 60. The Y-axis motor 134 drives the embroidery frame movement mechanism 11 and thereby causes the embroidery frame 84 to move in the front-rear direction. The drive circuit 133 drives the Y-axis motor 134 in accordance with a control signal from the control portion 60.

The operation portion 6 is provided with the touch panel 8, the connector 9, a drive circuit 135, the LCD 7, and the start/stop switch 41. The drive circuit 135 drives the LCD 7 in accordance with a control signal from the control portion 60. The connector 9 has a function to connect with the USB device 160. For example, a personal computer (PC) and a USB memory can be used as the USB device 160.

The control portion 60 is provided with a CPU 61, a ROM 62, a RAM 63, an EEPROM 64, and an input/output interface 66, and they are mutually connected by a signal line 65. The needle drive portion 120, the sewing target drive portion 130, the operation portion 6, and the image sensor 50 are respectively connected to the input/output interface 66.

The CPU 61 performs main control of the sewing machine 1. The CPU 61 performs various operations and processing that relate to sewing, in accordance with various programs stored in a program storage area (not shown in the drawings) of the ROM 62. Although not shown in the drawings, the ROM 62 is provided with a plurality of storage areas including the program storage area and a pattern storage area. Various programs to operate the sewing machine 1, including a main program, are stored in the program storage area. The main program is a program to perform main processing, which will be described later. Sewing data, which is data to sew a pattern (hereinafter also referred to as an "embroidery pattern"), is stored in the pattern storage area. The RAM 63 is a memory unit that is freely readable and writable. The RAM 63 includes, if necessary, a storage area to store operation results etc. processed by the CPU 61. The EEPROM 64 is a readable and writable memory unit. Various parameters for the sewing machine 1 to perform various types of processing are stored in the EEPROM 64. Further, each of the needle bars 31, and the color of the needle thread 15 that is supplied to the needle hole (not shown in the drawings) of the needle 35 that is attached to the lower end of each of the needle bars 31, are associated and stored in the EEPROM 64.

Operations to form stitches on the sewing target object 39 held by the embroidery frame 84 will be explained with reference to FIG. 1 to FIG. 3. The embroidery frame 84 that holds the sewing target object 39 is supported by the embroidery frame movement mechanism 11. One of the ten needle bars 31 is selected by movement of the needle bar case 21 from side to side. The embroidery frame 84 is moved to a predetermined position by the embroidery frame movement mechanism 11. When a drive shaft (not shown in the drawings) is driven and rotated by the drive shaft motor 122, the needle bar drive mechanism 32 and a thread take-up lever drive mechanism (not shown in the drawings) are driven, and the selected needle bar 31 and the thread take-up lever 19 corresponding to the selected needle bar 31 are vertically driven. Further, the shuttle drive mechanism is driven by rotation of the drive shaft motor 122, and the shuttle is driven and rotated. In this way, the needle 35, the thread take-up lever 19, and the shuttle are driven in a synchronized manner, and stitches are formed on the sewing target object 39.

Sewing data of the present embodiment will be explained. The sewing data of the present embodiment includes coordinate data of an embroidery coordinate system 100 shown in FIG. 2. The embroidery coordinate system 100 is a coordinate system of the X-axis motor 132 that causes the X carriage 22 to move and the Y-axis motor 134. The coordinate data of the embroidery coordinate system 100 represents a position and an angle of the embroidery pattern with respect to a reference. Examples of the reference include the X carriage 22. The embroidery frame 84 that holds the sewing target object 39 is attached to the X carriage 22. Therefore, the coordinate data of the embroidery coordinate system 100 represents the position and the angle of the embroidery pattern with respect to the sewing target object 39 held by the embroidery frame 84. In the present embodiment, the embroidery coordinate system 100 and a world coordinate system are associated with each other in advance. The world coordinate system is a coordinate system that shows the whole space. The world coordinate system is a coordinate system that is not affected by the center of gravity etc. of an image capturing target object.

Figure 2:
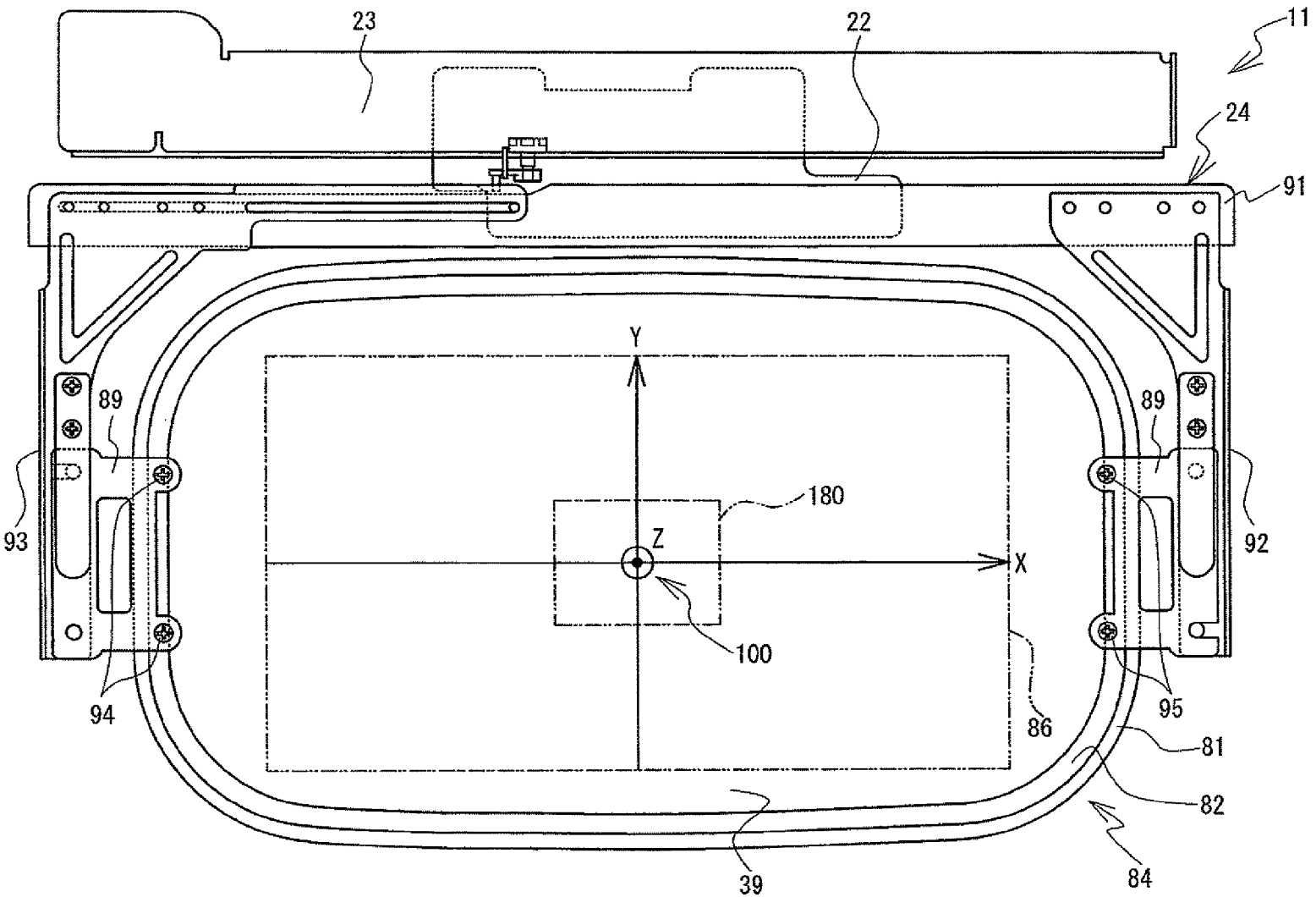
FIG. 2 is a plan view of an embroidery frame movement mechanism 11.

As shown in FIG. 2, in the embroidery coordinate system 100, a direction from the left toward the right of the sewing machine 1 is an X-axis plus direction, and a direction from the front toward the rear of the sewing machine 1 is a Y-axis plus direction. In the present embodiment, an initial position of the embroidery frame 84 is set as the origin (X, Y, Z)=(0, 0, 0) of the embroidery coordinate system 100. The initial position of the embroidery frame 84 is a position at which a center point of a sewable area 86 corresponding to the embroidery frame 84 matches a needle drop point. The needle drop point is a point at which the needle 35 (refer to FIG. 3) disposed vertically above the needle hole 36 (refer to FIG. 1) pierces the sewing target object 39 when the needle bar 31 is moved downwardly from above the sewing target object 39. The embroidery frame movement mechanism 11 of the present embodiment does not cause the embroidery frame 84 to move in a Z direction (the up-down direction of the sewing machine 1). Therefore, if the thickness of the sewing target object 39 is within a negligible range, an upper surface of the sewing target object 39 is taken as Z=0.

Coordinate data of the sewing data stored in the ROM 62 defines an initial layout of the embroidery pattern. The initial layout of the embroidery pattern is set such that a center point of the embroidery pattern matches the center point of the sewable area 86. The coordinate data of the sewing data is appropriately corrected when the layout of the embroidery pattern with respect to the sewing target object 39 is changed. In the first and second embodiments, the layout of the embroidery pattern with respect to the sewing target object 39 is set in accordance with the main processing, which will be described later. In the explanation below, the position of the embroidery pattern (the center point of the embroidery pattern) and the angle of the embroidery pattern are set with respect to the sewing target object 39 held by the embroidery frame 84, using data represented by the embroidery coordinate system 100.

When the image sensor 50 is disposed at an image capturing position, an image capturing range of the image sensor 50 in an X-Y plane of the embroidery coordinate system 100 is a rectangular range centered on a point that is directly below the center of the lens of the image sensor 50. A length of the rectangular range in the left-right direction is approximately 80 mm, and a length in the front-rear direction is approximately 60 mm. The image capturing position of the present embodiment is a position at which the center of the lens of the image sensor 50 is disposed directly above the needle hole 36. When the image sensor 50 is disposed at the image capturing position and the embroidery frame 84 is disposed at the initial position, an image capturing range 180 is a rectangular range centered on the origin of the embroidery coordinate system 100 as shown in FIG. 2.

Figure 4:
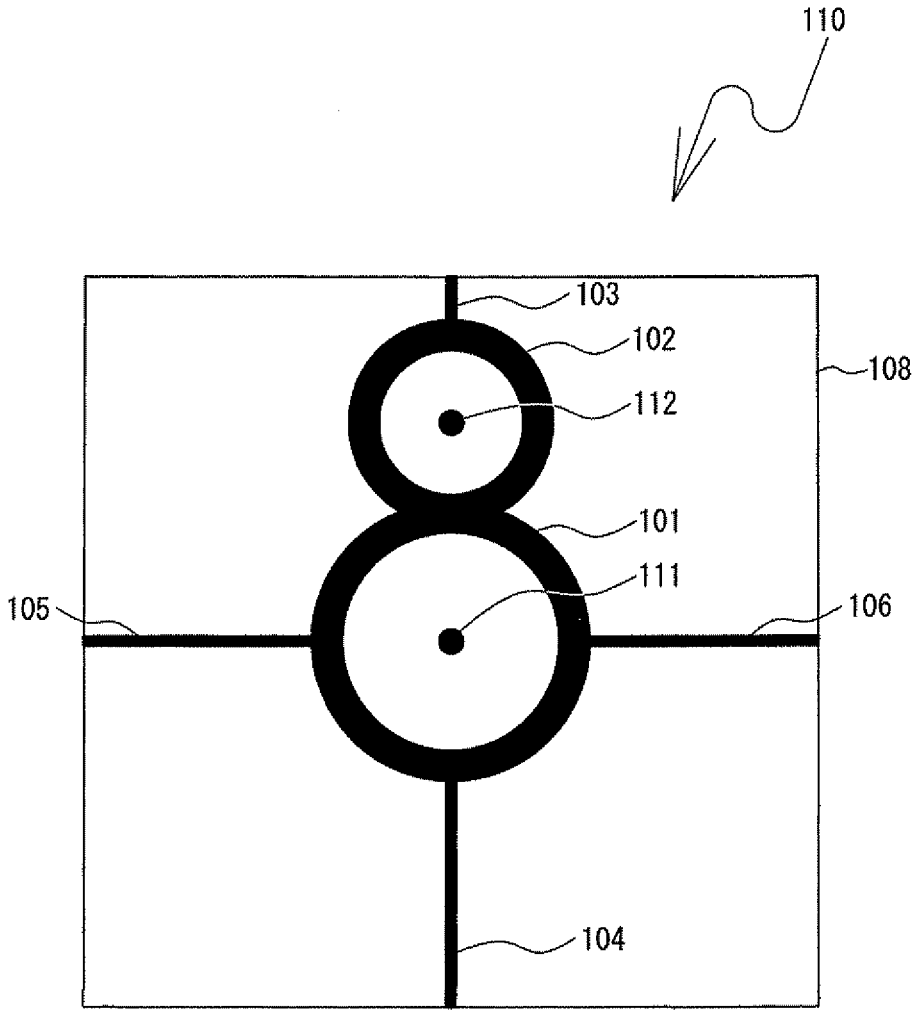
FIG. 4 is a plan view of a marker 110.

An explanation will be made assuming that the upper side, the lower side, the left side, and the right side of FIG. 4 respectively correspond to the upper side, the lower side, the left side, and the right side of the pattern drawn in a marker 110. The marker 110 is made such that the pattern is drawn on an upper surface of a white base sheet 108 having a thin plate shape. The base sheet 108 has a square shape in which the length and the width are both 2.5 cm, for example. A first circle 101, a second circle 102, a first center point 111, and a second center point 112 are drawn on the upper surface of the base sheet 108. The second circle 102 is arranged above the first circle 101. The diameter of the second circle 102 is smaller than the diameter of the first circle 101. The first center point 111 is the center of the first circle 101. The second center point 112 is the center of the second circle 102. Further, line segments 103 to 106 are drawn on the upper surface of the base sheet 108. The line segment 103 and the line segment 104 overlap with a virtual straight line (not shown in the drawings) that passes through the first center point 111 and the second center point 112. The line segment 105 and the line segment 106 overlap with a virtual straight line (not shown in the drawings) that passes through the first center point 111 of the first circle 101 and that is orthogonal to the line segment 103. The line segments 103 to 106 are respectively drawn to the outer edges of the base sheet 108.

A transparent adhesive is applied to a back surface of the base sheet 108. It is therefore possible to adhere the base sheet 108 onto the sewing target object 39. Normally, the base sheet 108 is adhered to release paper (not shown in the drawings). A user peels the base sheet 108 from the release paper and uses it.

Figure 5:
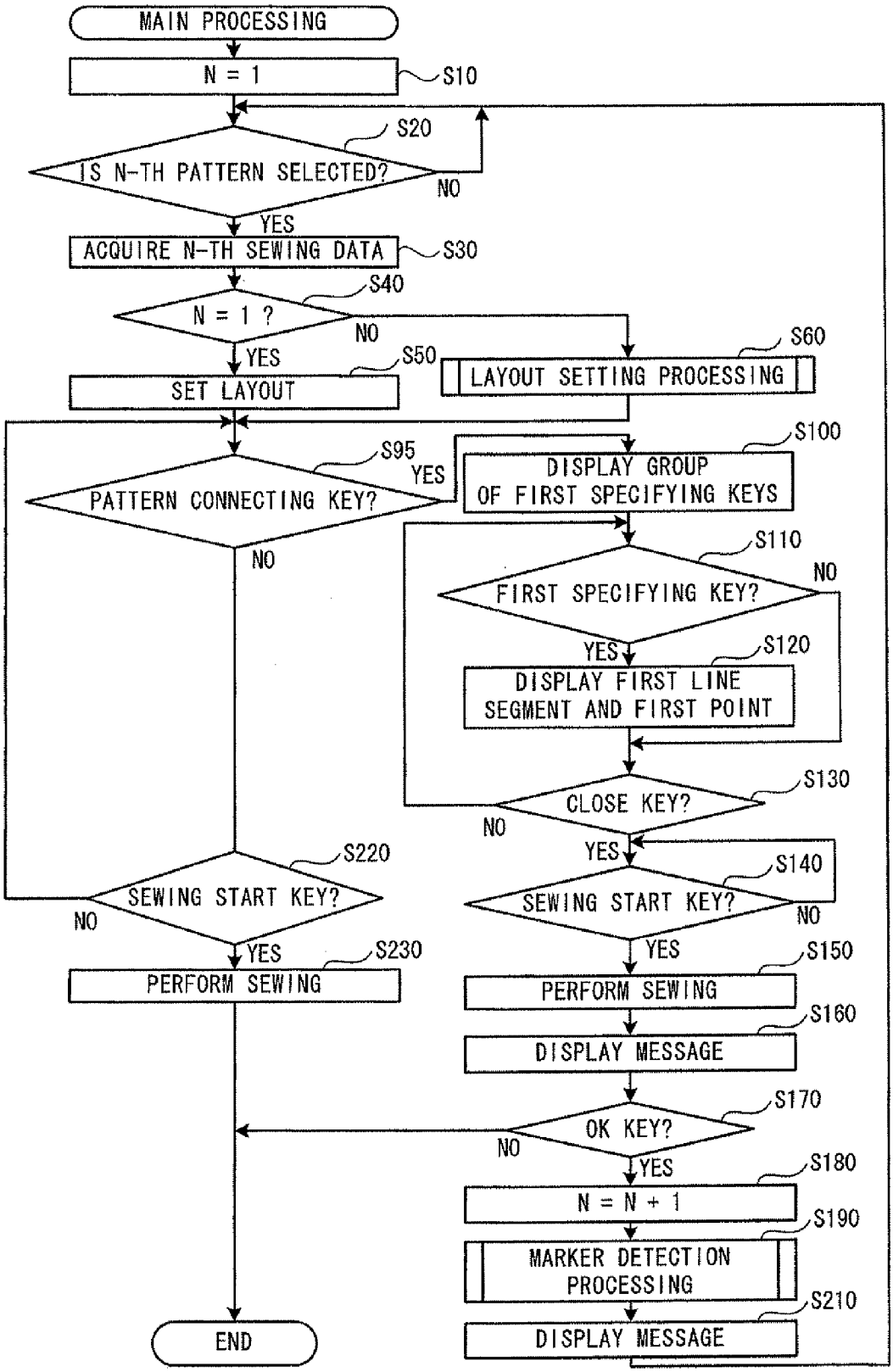
FIG. 5 is a flowchart of main processing.
Figure 6:
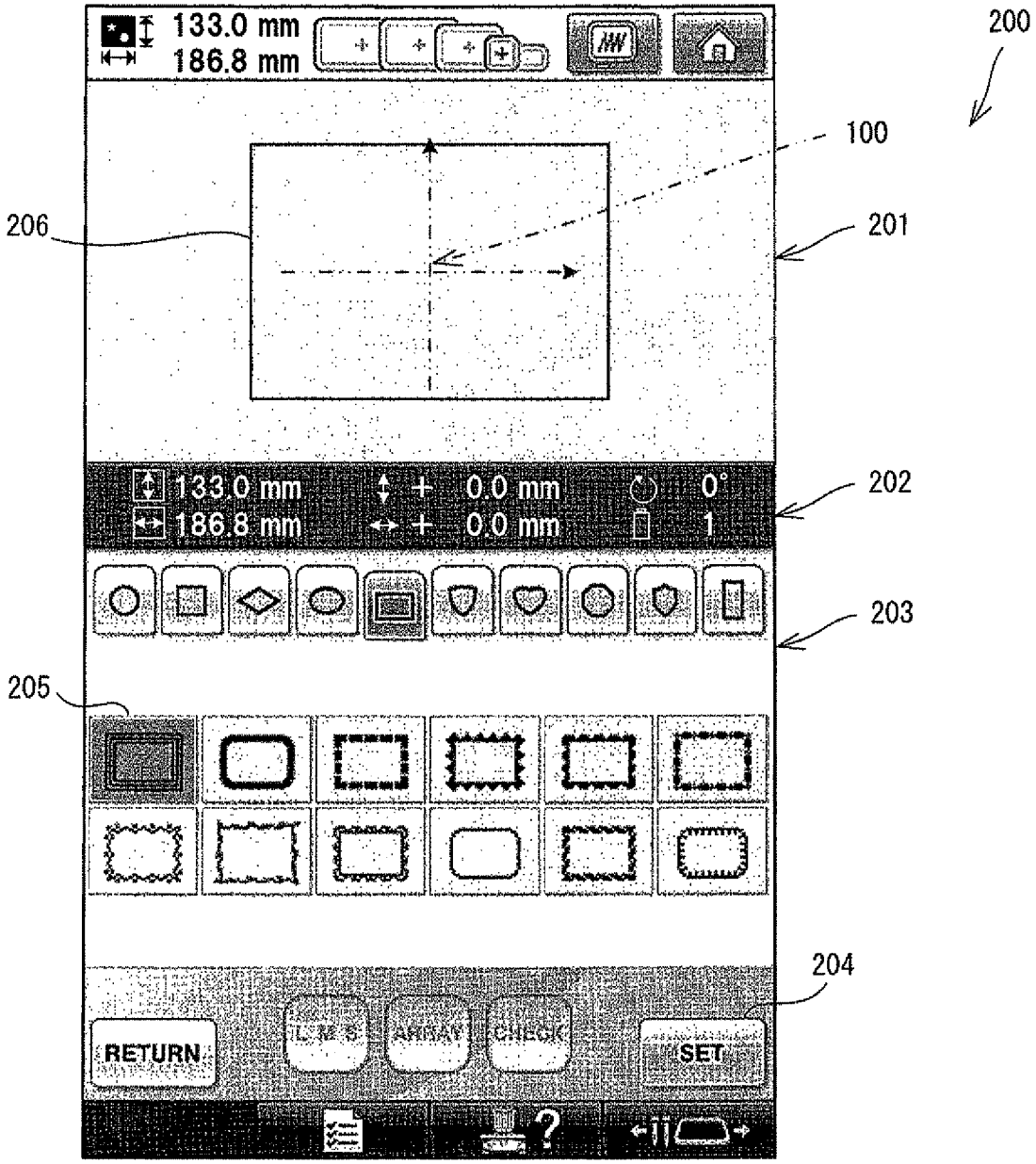
FIG. 6 is an explanatory diagram of a screen 200.

The main processing shown in FIG. 5 is processing that is performed when sewing a pattern that has a size falling within the sewable area set inside the embroidery frame. In the main processing of the present embodiment, particularly, when a plurality of patterns are sewn in a range larger than the sewable area set inside the embroidery frame, it is possible to adjust the layout between the patterns in accordance with a command from the user. As a specific example, a case will be explained in which patterns 205, an example of which is shown in FIG. 6, are arranged side by side in the X-axis direction and sewn. The size of the pattern 205 is set such that the length in the X-axis direction is 186.8 mm and the length in the Y-axis direction is 133.0 mm. When the size of the sewable area 86 is set such that the length in the X-axis direction is 360 mm and the length in the Y-axis direction is 200 mm, the single pattern 205 falls within the sewable area 86. However, when the two patterns 205 are not overlapped and are sewn, for example, by arranging them side by side in the X-axis direction with a predetermined interval therebetween, the two patterns 205 do not fall within the sewable area 86.

The main processing is performed when the user inputs a command to start the main processing. The command to start the main processing is input by a panel operation, for example. A program to perform the main processing is stored in the ROM 62 and is performed by the CPU 61. In the explanation below, an image represented by image data generated by the image sensor 50 is referred to as a captured image. Various screens and messages shown as examples are displayed on the LCD 7 when a control signal is output to the drive circuit 135. In the various screens that are shown as examples, the left-right direction and the up-down direction of the drawings are respectively referred to as the left-right direction and the up-down direction of the screens.

In the main processing, first, a variable N is set to 1 and the set variable N is stored in the RAM 63 (step S10). The variable N is a variable to count the number of the patterns selected by the user. The variable N corresponds to a sewing order of the selected patterns. Next, the CPU 61 stands by until an N-th pattern is selected (no at step S20). At step S20, first, a screen 200 exemplified in FIG. 6 is displayed. A pattern display column 201, a pattern information column 202, a pattern selection column 203, and a SET key 204 are displayed on the screen 200.

A graphic that represents a range in which the currently selected pattern is to be sewn is displayed in the pattern display column 201. The size of the pattern display column 201 represents the maximum size of the sewable area that is set for the sewing machine 1. The size of the sewable area 86 (refer to FIG. 2), which is set when the embroidery frame 84 is attached, corresponds to the size of the pattern display column 201. The left-right direction of the pattern display column 201 corresponds to the X-axis direction of the embroidery coordinate system 100. The up-down direction of the pattern display column 201 corresponds to the Y-axis direction of the embroidery coordinate system 100. In the present embodiment, the graphic that represents the range in which a pattern is sewn is shown by a rectangle. In a state before the layout of the patterns 205 is changed, a rectangle 206 that represents the range in which the patterns 205 are sewn includes sides that are parallel in the left-right direction of the pattern display column 201, and sides that are parallel in the direction perpendicular to the up-down direction of the pattern display column 201. The size of the above-described rectangle, a movement distance and a rotation angle with respect to the initial layout, and the number of thread colors that are necessary for sewing are displayed in the pattern information column 202, as information relating to the currently selected pattern. Pattern candidates are displayed in the pattern selection column 203 based on the sewing data stored in the ROM 62 or the EEPROM 64. The user selects a desired pattern by a panel operation from among the patterns displayed in the pattern selection column 203. After the pattern is selected, the SET key 204 is selected. At step S20, when one of the patterns is selected from among the patterns in the pattern selection column 203 by the panel operation and thereafter the SET key 204 is selected, it is determined that the N-th pattern is selected (yes at step S20). In this case, the sewing data corresponding to the selected N-th pattern is acquired from the ROM 62 or the EEPROM 64 and is stored in the RAM 63 (step S30).

On the screen 200, when the SET key 204 is selected after the pattern 205 is selected as a first pattern (yes at step S20, step S30, yes at step S40), editing of the N-th pattern and setting of the layout are performed (step S50). When the variable N is 1, the sewing data acquired at step S30 is corrected by a known method in accordance with the pattern editing and the layout setting.

Figure 7:
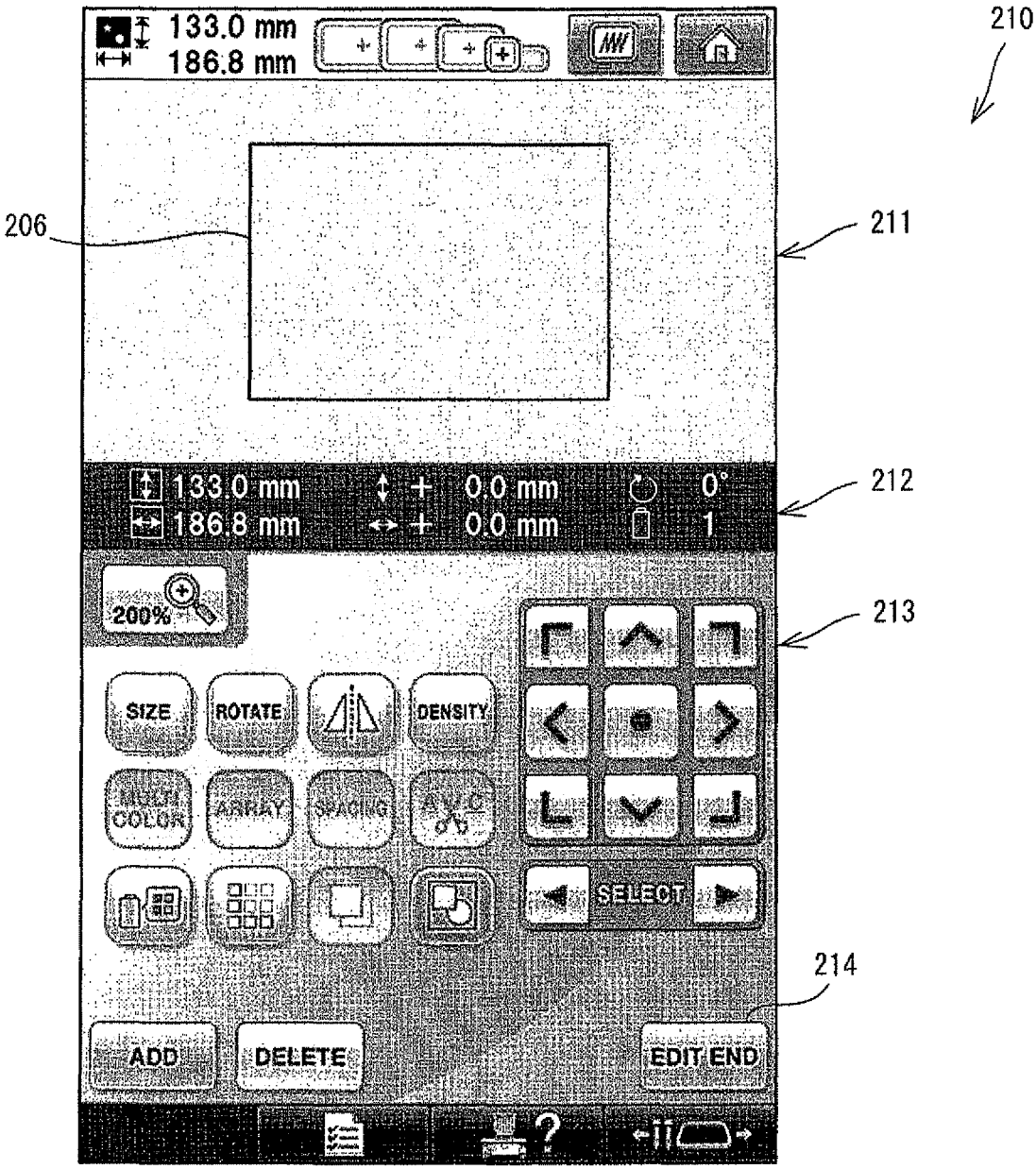
FIG. 7 is an explanatory diagram of a screen 210.

At step S50, first, a screen 210 exemplified in FIG. 7 is displayed. A pattern display column 211, a pattern information column 212, a pattern editing column 213, and an EDIT END key 214 are displayed on the screen 210. The pattern display column 211 is similar to the pattern display column 201, and the pattern information column 212 is similar to the pattern information column 202. Various types of keys, which are used to command the pattern editing and layout, are displayed in the pattern editing column 213. The user can command the pattern editing and layout by selecting the keys displayed in the pattern editing column 213 by panel operations. Examples of the pattern editing and layout include a size change of the pattern, rotation of the pattern with respect to an initial layout, reversal of the pattern, and movement of the pattern with respect to the initial layout. The initial layout of the pattern is defined by the sewing data as described above. After the pattern editing and layout is completed, the EDIT END key 214 is selected.

In the specific example shown in FIG. 7, a case is assumed in which the layout of the pattern 205 represented by the rectangle 206 is rotated by 348 degrees in the clockwise direction with respect to the initial layout, and the rectangle 206 is moved by −45.0 mm in the X-axis direction and by −15.6 mm in the Y-axis direction. When the EDIT END key 214 is selected after the pattern editing and layout is completed, a screen including a sewing start key and a pattern connecting key (which are not shown in the drawings) is displayed on the LCD 7. The sewing start key is selected to command start of the sewing of the pattern. The pattern connecting key is selected when an (N+1)-th pattern is sewn in addition to the N-th pattern selected at step S20, and also when the whole of the N-th pattern and the (N+1)-th pattern is sewn in a range that is larger than the sewable area.

Figure 8:
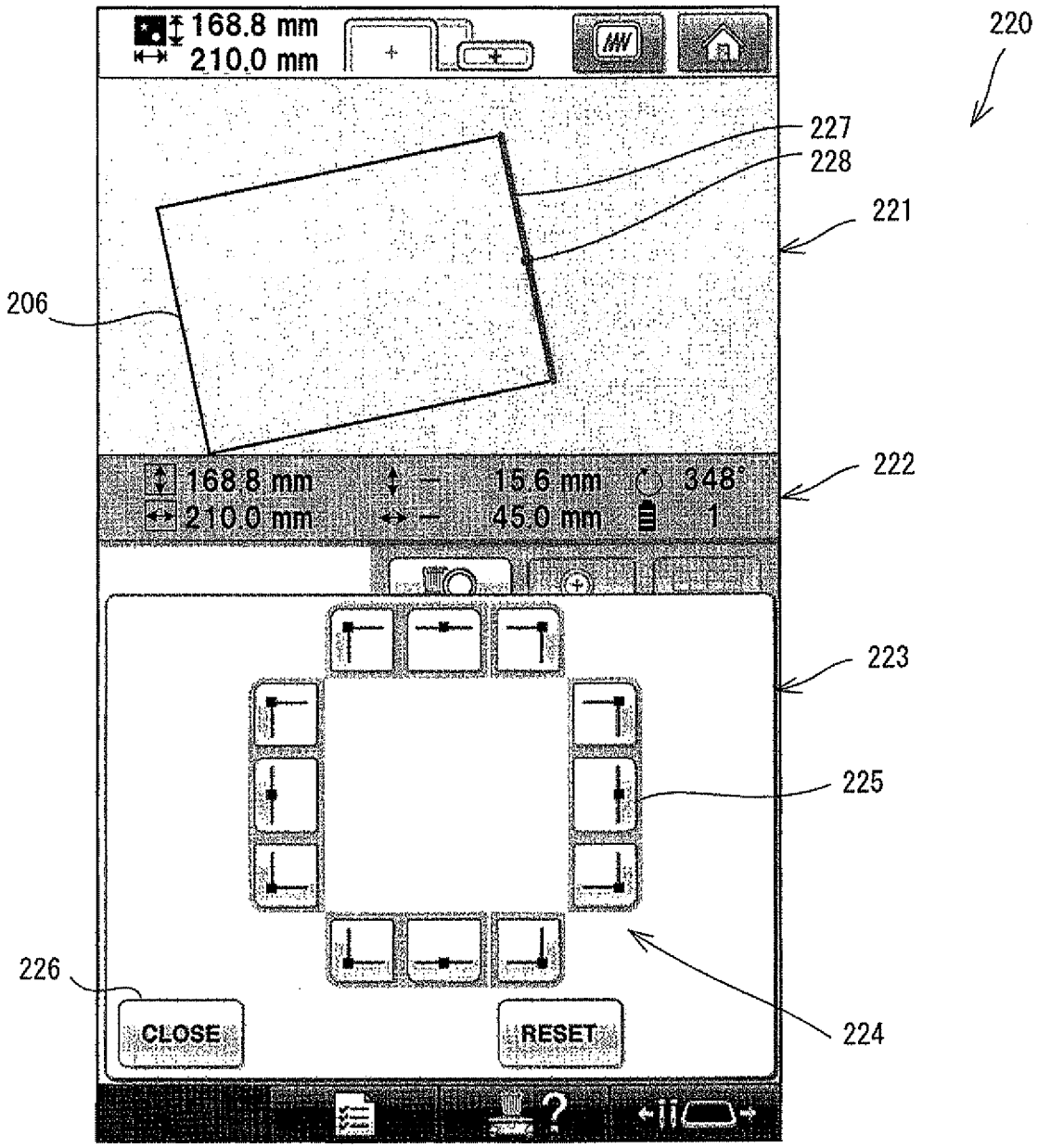
FIG. 8 is an explanatory diagram of a screen 220.

Next, it is determined whether the pattern connecting key has been selected (step S95). When the pattern connecting key has been selected (yes at step S95), a group of first specifying keys 224 are displayed as shown on a screen 220 shown in FIG. 8 (step S100). A pattern display column 221, a pattern information column 222, and a command key display column 223 are displayed on the screen 220. The pattern display column 221 is similar to the pattern display column 201, and the pattern information column 222 is similar to the pattern information column 202. The group of first specifying keys 224 and a CLOSE key 226 are displayed in the command key display column 223. Each of the first specifying keys included in the group of first specifying keys 224 is a key to specify a first reference.

The first reference is specified by the user, and is a reference including at least one of a first line segment and a first point that are included in a first graphic. When the N-th pattern is taken as a reference pattern and the (N+1)-th pattern is taken as a next pattern, the first reference is used in processing that sets the layout of the next pattern with respect to the layout of the reference pattern. The first graphic is a graphic representing a range in which the reference pattern (the N-th pattern) is sewn. The first reference of the present embodiment includes the first line segment and the first point. The first graphic of the present embodiment is the smallest rectangle in which the pattern can be arranged. The first line segment is selected from among four sides of the rectangle. The first point is selected from among both end points of the first line segment and a midpoint of the first line segment. In the present embodiment, a combination of the first line segment and the first point is selected as the first reference, from among the twelve first specifying keys included in the group of first specifying keys 224. After the first reference has been specified, the CLOSE key 226 is selected.

Next, it is determined whether one of the first specifying keys is selected from among the group of first specifying keys 224 (step S110). When a first specifying key 225 is selected on the screen 220 (yes at step S110), a first line segment 227 and a first point 228 are added to the rectangle 206 and displayed as shown in the pattern display column 221 (step S120). The first line segment 227 and the first point 228 are associated with the first specifying key 225. The sewing machine 1 of the present embodiment displays the rectangle 206 in black, the first line segment 227 in blue, and the first point 228 in red, respectively, so that the user can easily visually check the first reference with respect to the rectangle 206. The layout of the rectangle 206 is identified by the sewing data represented by the embroidery coordinate system. At step S120, the layout of the first line segment 227 and the first point 228 in a first holding position is identified by coordinates of the embroidery coordinate system based on the sewing data, and is stored in the RAM 63.

Among the holding positions of the sewing target object 39 with respect to the embroidery frame 84, the first holding position is a position when the reference pattern set by the user is sewn. The holding position of the sewing target object 39 with respect to the embroidery frame 84 is set by the user causing the embroidery frame 84 to hold the sewing target object 39. When none of the first specifying keys is selected from among the group of first specifying keys 224 (no at step S110), or after step S120, it is determined whether the CLOSE key 226 has been selected (step S130). When the CLOSE key has not been selected (no at step S130), the processing returns to step S110. When the CLOSE key 226 has been selected (yes at step S130), a screen including the sewing start key (not shown in the drawings) is displayed on the LCD 7.

Next, the CPU 61 stands by until the sewing start key is selected (no at step S140). When the sewing start key has been selected (yes at step S140), sewing of the N-th pattern is performed (step S150). Specifically, a control signal is output to the drive circuits 131 and 133 in accordance with the sewing data of the N-th pattern, and the embroidery frame 84 is moved. A control signal is output to the drive circuit 121 and the drive shaft motor 122 is driven.

Next, a message "Sew the next pattern?" and an OK key are displayed on the LCD 7 (step S160). The message is displayed to verify with the user whether to perform processing to sew the next pattern (the (N+1)-th pattern). The OK key is selected when the processing to sew the next pattern is performed. When the OK key is not selected for a predetermined time period (for five minutes, for example) (no at step S170), the main processing ends. When the OK key is selected (yes at step S170), the variable N is incremented by 1 and the incremented variable N is stored in the RAM 63 (step S180).

Figure 9:
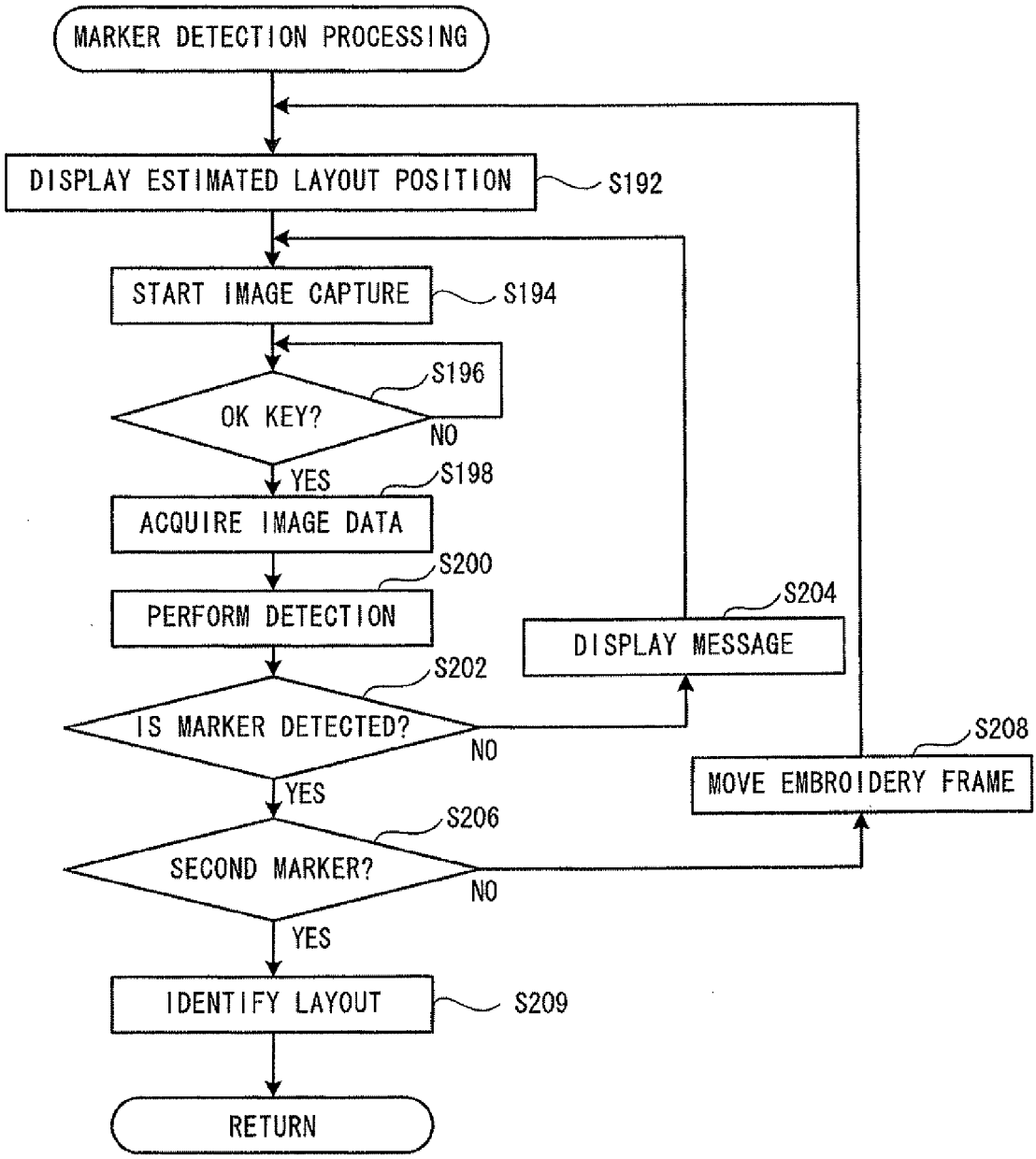
FIG. 9 is a flowchart of marker detection processing that is performed in the main processing shown in FIG. 5.

Next, marker detection processing shown in a flowchart in FIG. 9 is performed (step S190). The marker detection processing is processing that associates the layout of the markers 110 in the first holding position with the first reference (the first line segment 227 and the first point 228). Since the variable N is incremented at step S180 (refer to FIG. 5), an (N−1)-th pattern corresponds to the above-described reference pattern and the N-th pattern corresponds to the above-described next pattern. The layout of the markers 110 includes at least one of the position and the angle of the markers 110. The sewing machine 1 of the present embodiment detects, as the layout of the markers 110, the position and the angle of the markers 110 based on coordinates of the embroidery coordinate system of the first center points 111 of the two markers 110.

Figure 10:
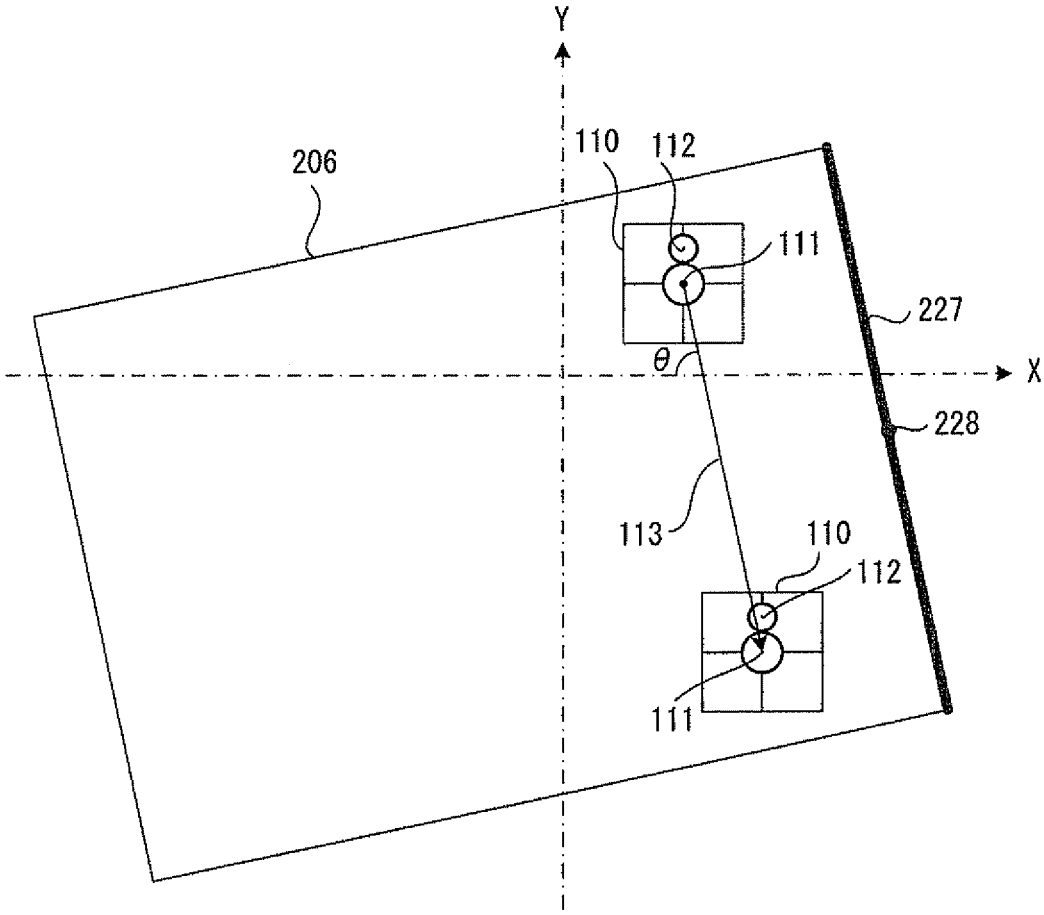
FIG. 10 is an explanatory diagram of an estimated layout position of the markers 110, with respect to a layout of a rectangle 206.

The position of the markers 110 is represented, for example, by the coordinates of the embroidery coordinate system of the first center point 111 of one of the two markers 110 shown in FIG. 10. The angle of the markers 110 is represented by an angle formed by the X-axis of the embroidery coordinate system and a vector directing from the first center point 111 of the one of the two markers 110 toward the first center point 111 of the other marker 110. A distinction between the two markers 110 is determined based on, for example, a relative position of the second center point 112 with respect to the first center point 111 in each of the markers 110. In the present embodiment, as exemplified in FIG. 10, based on a captured image of the two markers 110 that are respectively arranged on the sewing target object 39 (refer to FIG. 2), the layout of the markers 110 in the first holding position is detected. Specifically, as shown in FIG. 10, the position of the markers 110 is represented by the embroidery coordinates of the first center points 111 of the markers 110. Further, the angle of the markers 110 is represented by an angle θ formed by the X-axis and a vector 113 directing from the first center point 111 of the one of the markers 110 (on the upper side in FIG. 10) toward the first center point 111 of the other marker 110 (on the lower side in FIG. 10).

Figure 11:
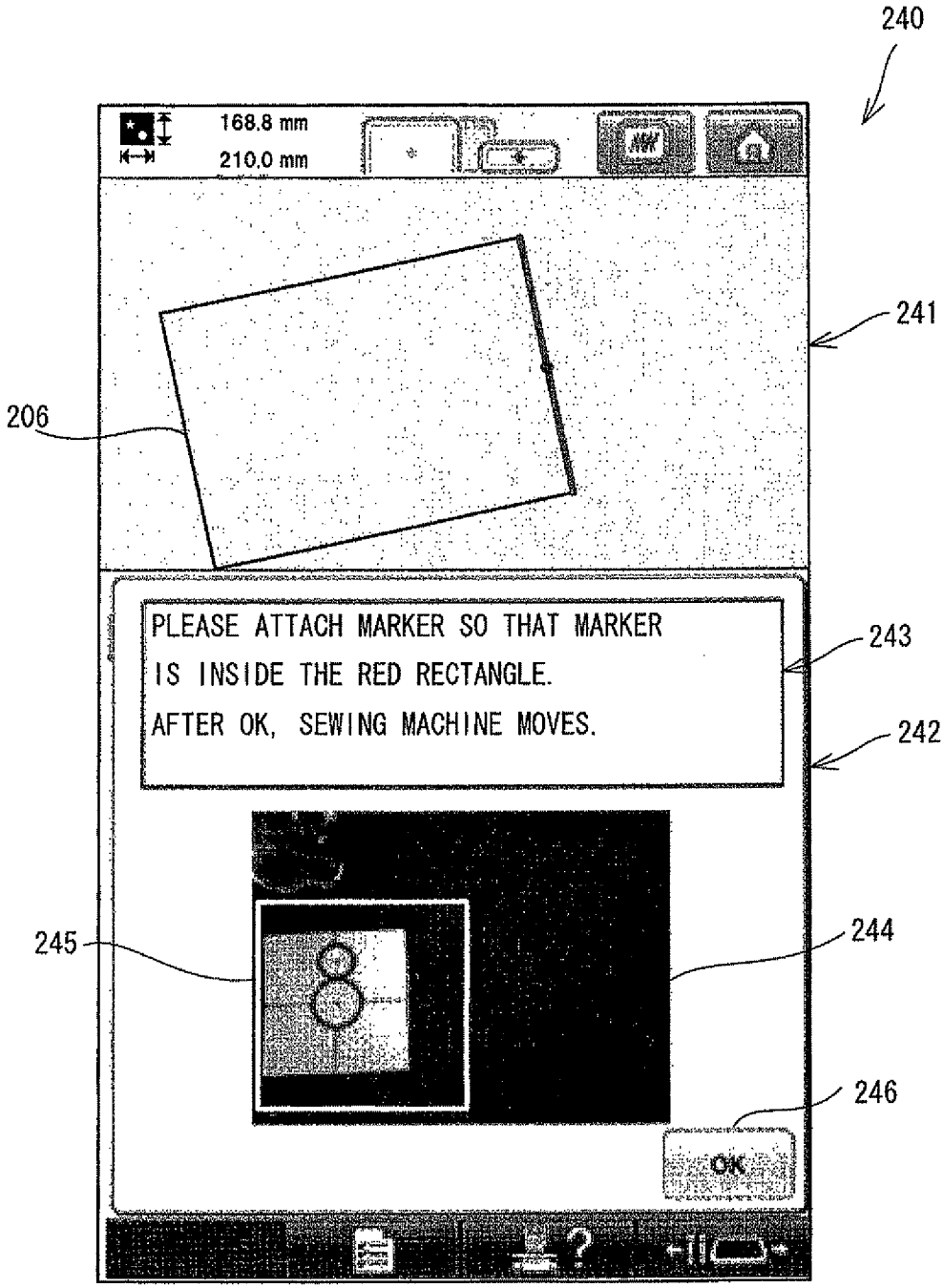
FIG. 11 is an explanatory diagram of a screen 240.

The marker detection processing will be explained in more detail with reference to FIG. 9. In the marker detection processing, first, as shown on a screen 240 exemplified in FIG. 11, a red rectangle 245 that shows an estimated layout position of the marker 110 is displayed on the LCD 7 (step S192), and image capture of the vicinity of the needle is started by the image sensor 50 (step S194). A pattern display column 241 and an estimated layout position display column 242 are displayed on the screen 240. The pattern display column 241 is similar to the pattern display column 201. A message 243, a composite image 244, and an OK key 246 are displayed in the estimated layout position display column 242.

The composite image 244 is an image in which the red rectangle 245 is added to the image of the vicinity of the needle output from the image sensor 50. On the image of the vicinity of the needle, the red rectangle 245 is displayed in the vicinity of one of the ends of the first line segment. The size of the rectangle 245 is approximately 1.5 times the size of the marker 110. The message 243 is displayed to prompt the user to select the OK key 246 after the marker 110 is arranged in an area inside the rectangle 245. After the marker 110 is arranged inside the rectangle 245, the OK key 246 is selected. While confirming the screen 240, the user attaches the marker 110 to the inside of the rectangle 245 as displayed in the estimated layout position display column 242, and after that, the user selects the OK key 246.

The CPU 61 stands by until the OK key 246 is selected (no at step S196). When the OK key 246 is selected (yes at step S196), image data output from the image sensor 50 is acquired and the acquired image data is stored in the RAM 63 (step S198). Next, processing is performed that detects the marker 110 from the image of a section inside the rectangle 245 (step S200). At step S200, when the marker 110 is detected from the image of the section inside the rectangle 245, the coordinates of the embroidery coordinate system of the first center point 111 and the second center point 112 that are included in the marker 110 are identified. The detection of the marker 110 and the identification of the coordinates are performed using a known method. Specifically, two-dimensional coordinates in an image coordinate system, which is a coordinate system of the image captured by the image sensor 50, are calculated for the first center point 111 and the second center point 112 of the marker 110, using Hough conversion processing, for example. After that, the two-dimensional coordinates of the image coordinate system are converted to three-dimensional coordinates of the world coordinate system. As described above, in the present embodiment, the embroidery coordinate system and the world coordinate system are associated with each other. Therefore, coordinates of the embroidery coordinate system are calculated based on the three-dimensional coordinates of the world coordinate system calculated by image processing. When the marker 110 is not detected at step S200 (no at step S202), a message that prompts the user to arrange the marker 110 in the rectangle 245 is displayed on the LCD 7 (step S204). Next, the processing returns to step S194. When the marker 110 is detected at step S200 (yes at step S202), it is determined whether the marker 110 detected at step S200 is the second marker 110 (step S206).

As described above, the sewing machine 1 of the present embodiment detects the two markers 110 that are respectively arranged in the vicinity of both the ends of the first line segment on the sewing target object 39, and associates the layout of the markers 110 with the layout of the reference pattern in the first holding position. When the marker 110 detected at step S200 is the first marker 110 (no at step S206), the control signal is output to the drive circuits 131 and 133 and the embroidery frame 84 is moved (step S208). Specifically, the embroidery frame 84 is moved so that the estimated layout position, which is set in the vicinity of the other end of the first line segment, falls within the image capturing range of the image sensor 50.

Figure 12:
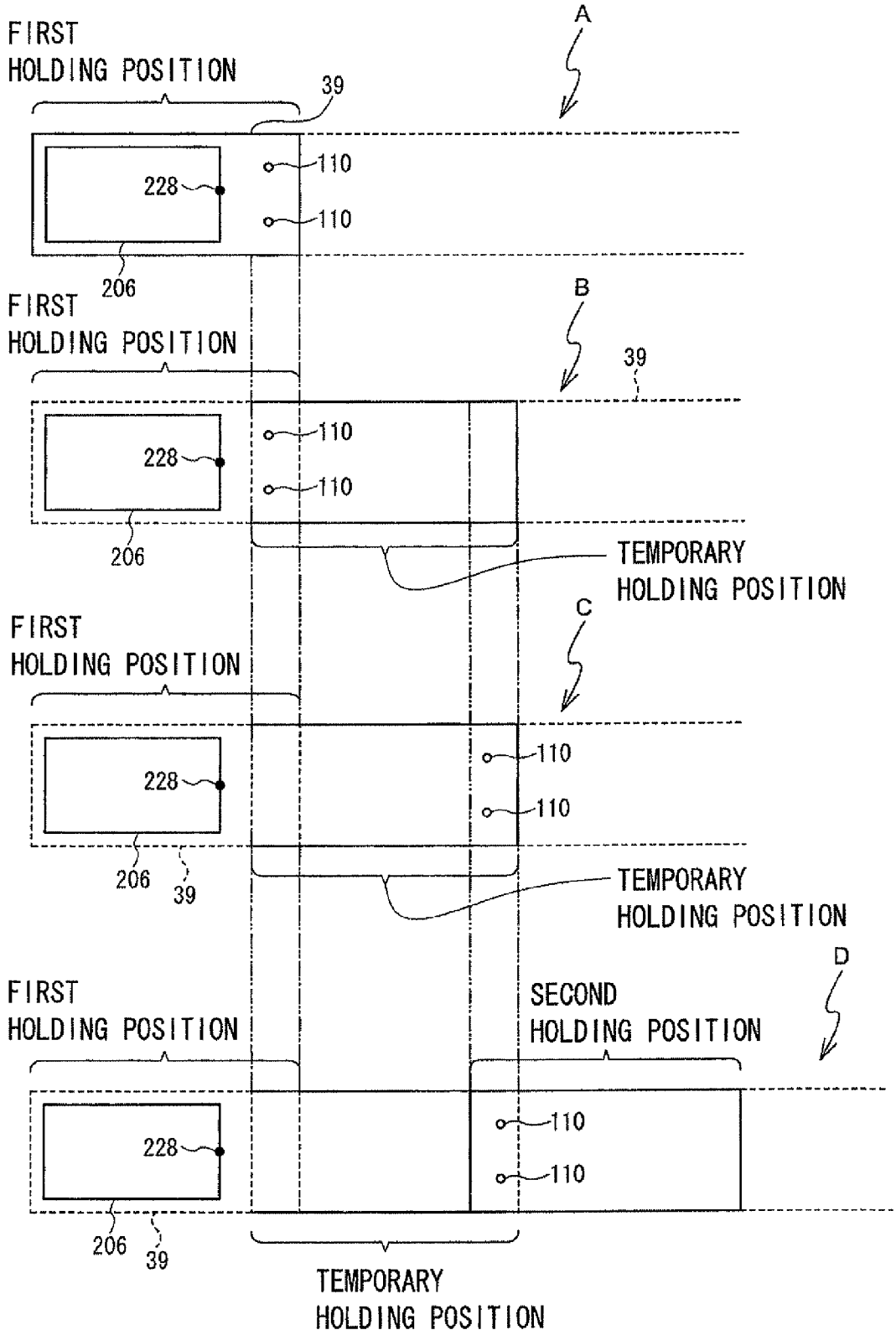
FIG. 12 is an explanatory diagram illustrating transition states of a holding position of a sewing target object and positions of the markers 110 during the main processing.

Next, the processing returns to step S192 and processing to detect the second marker 110 is performed. When the marker 110 detected at step S200 is the second marker 110 (yes at step S206), based on embroidery coordinates of the detected marker 110 and embroidery coordinates of the first reference, the layout of the markers 110 with respect to the first reference in the first holding position shown in a state A in FIG. 12 is identified. The identified layout of the markers 110 is registered in the RAM 63 (step S209). Specifically, the embroidery coordinates of the first center point 111 (shown in FIG. 10) of the marker 110 in the first holding position are associated with the coordinates of the first reference (the first line segment 227 and the first point 228) in the first holding position identified at step S120 of the main processing (refer to FIG. 5). Based on the association, the layout (including the position and angle) of the markers 110 with respect to the first reference in the first holding position is identified. After that, the marker detection processing ends and the processing returns to the main processing.

Subsequent to step S190, a message is displayed that prompts the user to change the holding position of the sewing target object 39 with respect to the embroidery frame 84 (step S210). After displaying this message, the user changes the holding position of the sewing target object 39 with respect to the embroidery frame 84, in a state in which the markers 110 are attached to the surface of the sewing target object 39. In other words, even if the holding position of the sewing target object 39 with respect to the embroidery frame 84 is changed, the layout of the markers 110 with respect to the sewing target object 39 is not changed. Specifically, without changing the layout of the markers 110, the user changes the holding position of the sewing target object 39 from the first holding position shown in the state A in FIG. 12 to a temporary holding position shown in a state B in FIG. 12. The temporary holding position is different from the first holding position, in terms of a relative holding position of the sewing target object 39 with respect to the embroidery frame 84 (refer to FIG. 2). The temporary holding position of the present embodiment needs to satisfy a condition that each of the two markers 110 attached to the sewing target object 39 is located inside the embroidery frame 84 (refer to FIG. 2).

Next, the processing returns to step S20. In the above-described specific example, it is assumed that the pattern 205 that is the same as the first pattern 205 is selected as the second pattern at step S20 (yes at step S20). In this case, after sewing data of the second pattern 205 is acquired (step S30), it is determined that the variable is not 1 (no at step S40). When the variable N is two or more, unlike a case in which the variable N is 1, layout setting processing is performed (step S60). In the layout setting processing, processing that sets the layout of the next pattern (the N-th pattern) in a second holding position is performed. At a time point of step S60, the reference pattern has already been sewn on the sewing target object 39, and the layout with respect to the sewing target object 39 has been determined. At step S60, processing that sets the layout of the next pattern (the N-th pattern) with respect to the sewing target object 39 in the second holding position is performed, based on a relative layout of the next pattern with respect to the layout of the reference pattern, and on the layout of the reference pattern in the second holding position.

The layout setting processing will be explained in more detail with reference to FIG. 13. In the layout setting processing, first, a group of second specifying keys 254 are displayed as shown in a screen 250 shown in FIG. 14 (step S62). A pattern display column 251, a pattern information column 252, and a command key display column 253 are displayed on the screen 250. The pattern display column 251 is similar to the pattern display column 201, and the pattern information column 252 is similar to the pattern information column 202. The group of second specifying keys 254, an OK key 256, and a marker detection key 259 are displayed in the command key display column 253. Second specifying keys included in the group of second specifying keys 254 are keys to specify a second reference. The second reference is specified by the user, and is a reference including at least one of a second line segment and a second point that are included in a second graphic.

The second graphic is a graphic representing a range in which the next pattern is sewn. In the present embodiment, the second graphic is a rectangle, similarly to the first graphic. The second reference of the present embodiment includes the second line segment and the second point. Similarly to the first line segment, the second line segment is selected from among four sides of the rectangle. Similarly to the first point, the second point is selected from among both end points of the second line segment and a midpoint of the second line segment. In the present embodiment, a combination of the second line segment and the second point is selected as the second reference, from among the twelve second specifying keys included in the group of second specifying keys 254. The second reference is used in processing that determines a relative layout of the next pattern (the N-th pattern) with respect to the layout of the reference pattern (the (N−1)-th pattern). After the second reference has been specified, the OK key 256 is selected. The marker detection key 259 is a key that is selected when the markers 110 are re-attached. If the marker detection key 259 is selected, the layout of the markers 110 after the reattachment with respect to the first reference is identified, and the layout is updated and registered in the RAM 63.

Next, it is determined whether one of the second specifying keys is selected from among the group of second specifying keys 254 (step S64). When one of the second specifying keys is selected on the screen 250 (yes at step S64), a relative layout of the second pattern 205 with respect to the layout of the first pattern 205 is determined (step S70). The determination result is displayed on the LCD 7 (step S72), and the processing proceeds to step S74. In the present embodiment, the layout of a pattern includes the position and angle of the pattern with respect to the initial layout. A relative layout of the next pattern (the N-th pattern) with respect to the layout of the reference pattern (the (N−1)-th pattern) is determined based on the first reference and the second reference in the following manner. That is, the relative layout of the next pattern with respect to the layout of the reference pattern is determined to be a layout in which an extending direction of the first line segment overlaps with the second line segment and the first point overlaps with the second point. Two types of layout that meet the above-described condition are conceivable as the relative layout of the next pattern with respect to the layout of the reference pattern. The two types of layout are a layout in which the reference pattern and the next pattern overlap with each other, and a layout in which the reference pattern and the next pattern do not overlap with each other. Of the two types of layout, the present embodiment adopts the layout in which the reference pattern and the next pattern (the N-th pattern) do not overlap with each other.

Figure 15:
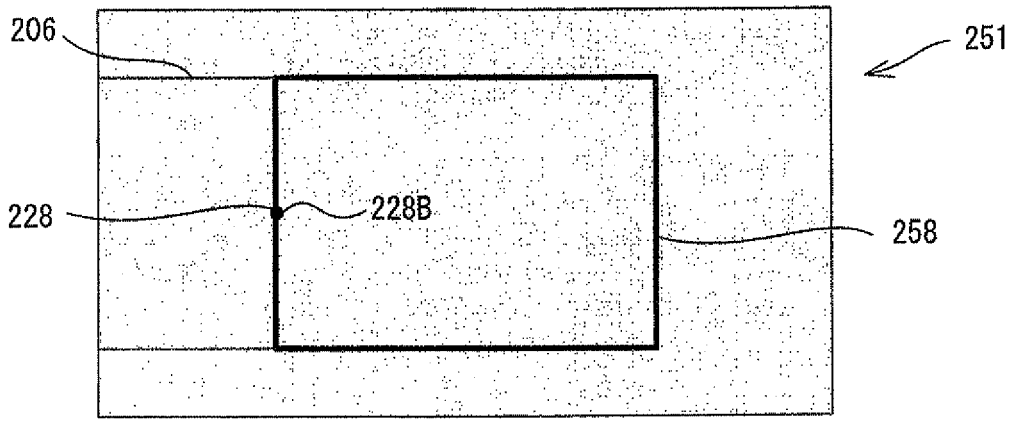
FIG. 15 is an explanatory diagram of a pattern display column 251.

When a second specifying key 255 is selected on the screen 250, as exemplified in the pattern display column 251, a relative layout of the second pattern 205 (refer to FIG. 6) with respect to the layout of the first pattern 205 (refer to FIG. 6) is determined in the following manner. That is, the relative layout is determined to be a layout in which the extending direction of the right side of the rectangle 206 including the first reference overlaps with a second line segment 227A that is shown by the left side of a rectangle 258 representing a range of the second pattern 205, and in which the midpoint (the first point 228) of the right side of the rectangle 206 overlaps with an end point 228A on the upper side of the left side of the rectangle 258. FIG. 15 shows the pattern display column 251 when a second specifying key 257 is selected on the screen 250. The relative layout of the second pattern 205 (refer to FIG. 6) with respect to the layout of the first pattern 205 (refer to FIG. 6) is determined in the following manner. That is, the relative layout is determined to be a layout in which the extending direction of the right side of the rectangle 206 representing the range of the first pattern 205 (refer to FIG. 6) overlaps with the left side of the rectangle 258 representing the range of the second pattern 205 (refer to FIG. 6), and in which the midpoint (the first point 228) of the right side of the rectangle 206 overlaps with a mid point 2288 of the left side of the rectangle 258. By looking at the screen displayed on the LCD 7, the user checks the relative layout of the next pattern (the N-th pattern) with respect to the layout of the reference pattern (the (N−1)-th pattern).

Figure 16:
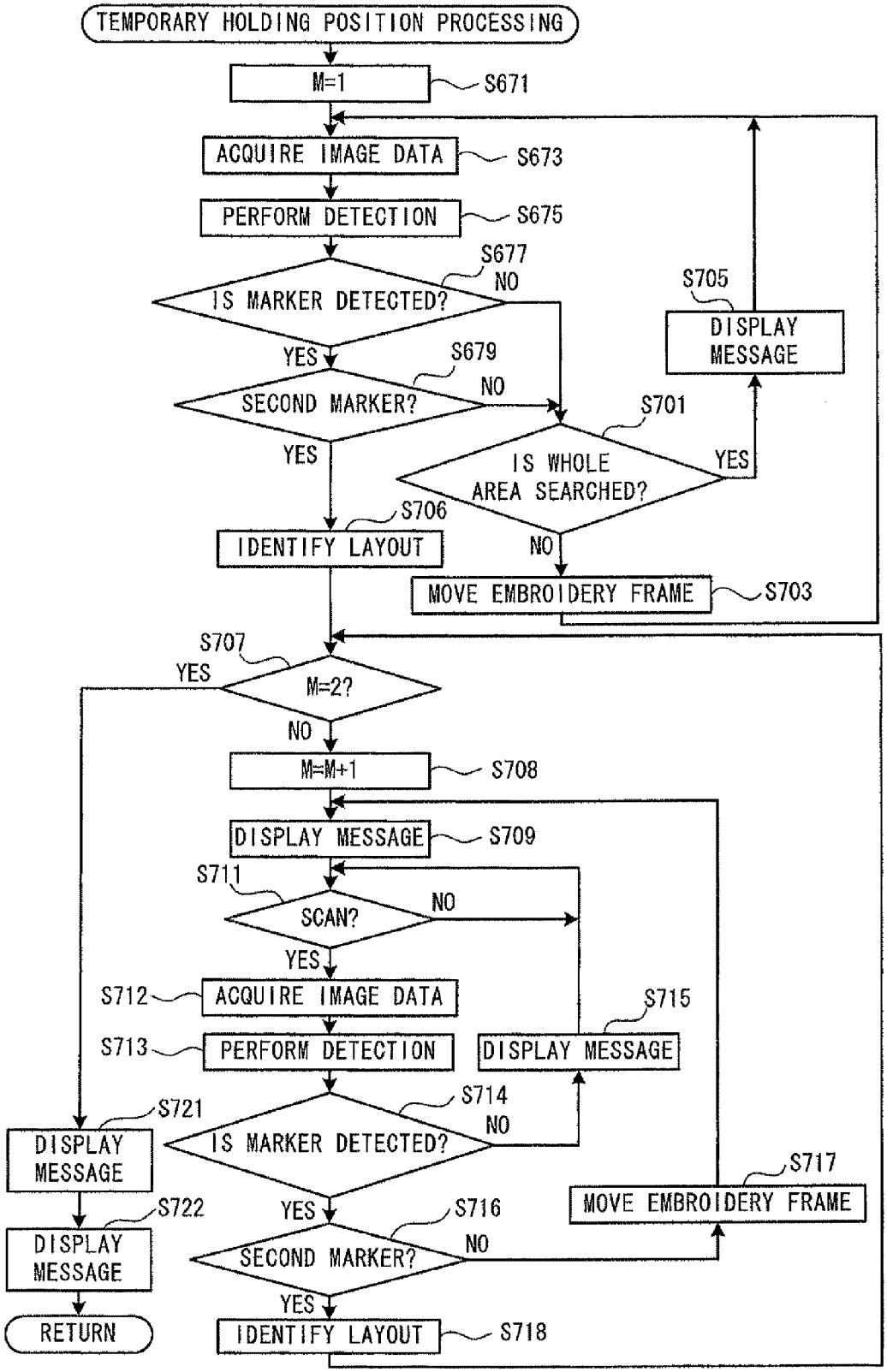
FIG. 16 is a flowchart of temporary holding position processing.

When none of the second specifying keys is selected from among the group of second specifying keys 254 (no at step S64), the marker detection key 259 is selected on the screen 250 and it is determined whether temporary holding position processing has been commanded (step S65). When the temporary holding position processing has not been commanded (no at step S65), the processing proceeds to step S74. On the other hand, when the temporary holding position processing has been commanded (yes at step S65), the processing proceeds to step S67 and the temporary holding position processing is performed. Unlike the marker detection processing shown in FIG. 9, in the temporary holding position processing, the whole inside of the embroidery frame 84 is set as a detection target range of the marker 110. The temporary holding position processing will be explained with reference to FIG. 16. In the temporary holding position processing, first, a variable M that indicates the number of detections of the marker 110 is set to 1, and the set variable M is stored in the RAM 63 (step S671). The image data output from the image sensor 50 is acquired (step S673), and detection processing of the marker 110 is performed taking the whole image represented by the image data acquired at step S673 as a detection target (step S675). The detection of the marker 110 is performed using a known method in a similar manner to step S200. When the marker 110 is detected (yes at step S677), the processing proceeds to step S679. The detection of the marker 110 is performed, for example, by detecting coordinates of the embroidery coordinate system of the first center point 111 and the second center point 112 of the marker 110.

On the other hand, when the marker 110 is not detected at step S677 (no at step S677), the processing proceeds to step S701. At step S679, it is determined whether the second marker 110 has been detected. When the second marker 110 has not been detected (no at step S679), the processing proceeds to step S701. At step S701, it is determined whether the whole inside area of the embroidery frame 84 is set as the detection target range. When an area that has not been set as the detection target range is present inside the embroidery frame 84 (no at step S701), the control signal is output to the drive circuits 131 and 133, and the embroidery frame 84 is moved so that the area that has not been set as the detection target range falls within the image capturing range of the image sensor 50 (step S703). When the whole inside area of the embroidery frame 84 is set as the detection target range (yes at step S701), a message informing that the two markers 110 cannot be detected is displayed on the LCD 7 (step S705). In this case, the user checks whether the two markers 110 are located in the inside area of the embroidery frame 84. After step S703 or step S705, the processing returns to step S673.

On the other hand, when the second marker 110 has been detected at step S679 (yes at step S679), the layout of the markers 110 with respect to the first reference in the temporary holding position shown in the state B in FIG. 12 is identified, based on the layout of the markers 110 with respect to the first reference in the first holding position shown in the state A in FIG. 12, and on the embroidery coordinates of the marker 110 detected at step S675. The identified layout of the markers 110 is updated and registered in the RAM 63 (step S706). Specifically, if the holding position of the sewing target object 39 is changed to the temporary holding position, the embroidery coordinate system in the temporary holding position is set and the origin is known. As a result, the embroidery coordinates of the markers 110 in the temporary holding position can be detected. Further, in the first holding position shown in the state A in FIG. 12, the embroidery coordinates of the first reference (the first line segment 227 and the first point 228) have already been associated and identified with the embroidery coordinates of the markers 110. Therefore, if the embroidery coordinates of the first reference in the first holding position are converted to the coordinates of the embroidery coordinate system in the temporary holding position, the embroidery coordinates of the first reference in the temporary holding position can be associated with the markers 110. Then, the layout (including the position and angle) of the markers 110 with respect to the first reference in the temporary holding position shown in the state B in FIG. 12 is identified.

Figure 17:
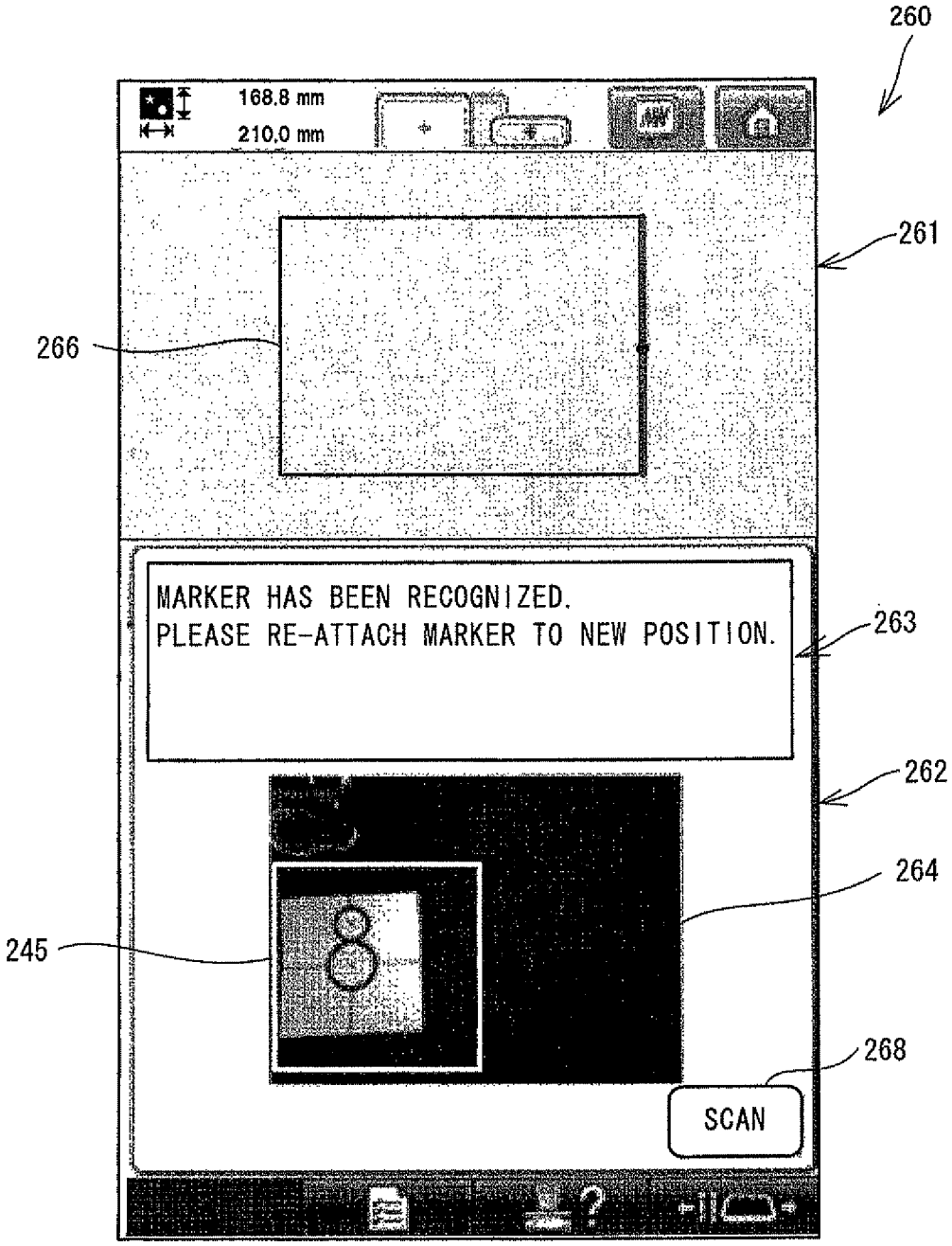
FIG. 17 is an explanatory diagram of a screen 260.

Next, it is determined whether a value of the variable M is 2 (step S707). When the value of the variable M is not 2 (no at step S707), the value of the variable M is incremented and set to 2 (step S708). A screen 260 exemplified in FIG. 17 is displayed (step S709). A pattern display column 261 and an estimated layout position display column 262 are displayed on the screen 260. The pattern display column 261 is similar to the pattern display column 241. A message 263 that prompts the user to re-attach the marker 110, a composite image 264, and a scan key 268 are displayed in the estimated layout position display column 262. The composite image 264 is similar to the composite image 244. After this message, while the holding position of the sewing target object 39 with respect to the embroidery frame 84 (shown in FIG. 2) is maintained, the marker 110 is re-attached, by the user referring to the rectangle 245, from the position shown in the state B in FIG. 12 to the position shown in a state C in FIG. 12. After the marker 110 has been re-attached, it is determined whether the scan key 268 shown in FIG. 17 has been selected (step S711). When the scan key 268 has not been selected (no at step S711), the processing returns to step S711 and stands by until the scan key 268 is selected. On the other hand, when the scan key 268 has been selected (yes at step S711), image data is acquired and processing that detects the two markers 110 is performed (step S712 to step S717). Content of the processing is similar to step S198 to step S208 of the above-described marker detection processing (refer to FIG. 9), and an explanation thereof is therefore omitted here. When the two markers 110 are detected (yes at step S716), the layout (including the position and angle) of the markers 110 with respect to the first reference in the temporary holding position shown in the state C in FIG. 12 is identified, based on the layout of the markers 110 with respect to the first reference in the temporary holding position shown in the state B in FIG. 12, the embroidery coordinates of the markers 110 before the reattachment, and the embroidery coordinates of the markers 110 after the reattachment. The identified layout is updated and registered in the RAM 63 (step S718). Specifically, since the embroidery coordinate system in the temporary holding position has been set, the embroidery coordinates of the markers 110 after the reattachment can be detected. Further, the layout (including the position and angle) of the markers 110 before the reattachment with respect to the first reference in the temporary holding position has already been identified. Therefore, the layout (including the position and angle) of the markers 110 after the reattachment with respect to the first reference can be identified.

Figure 18:
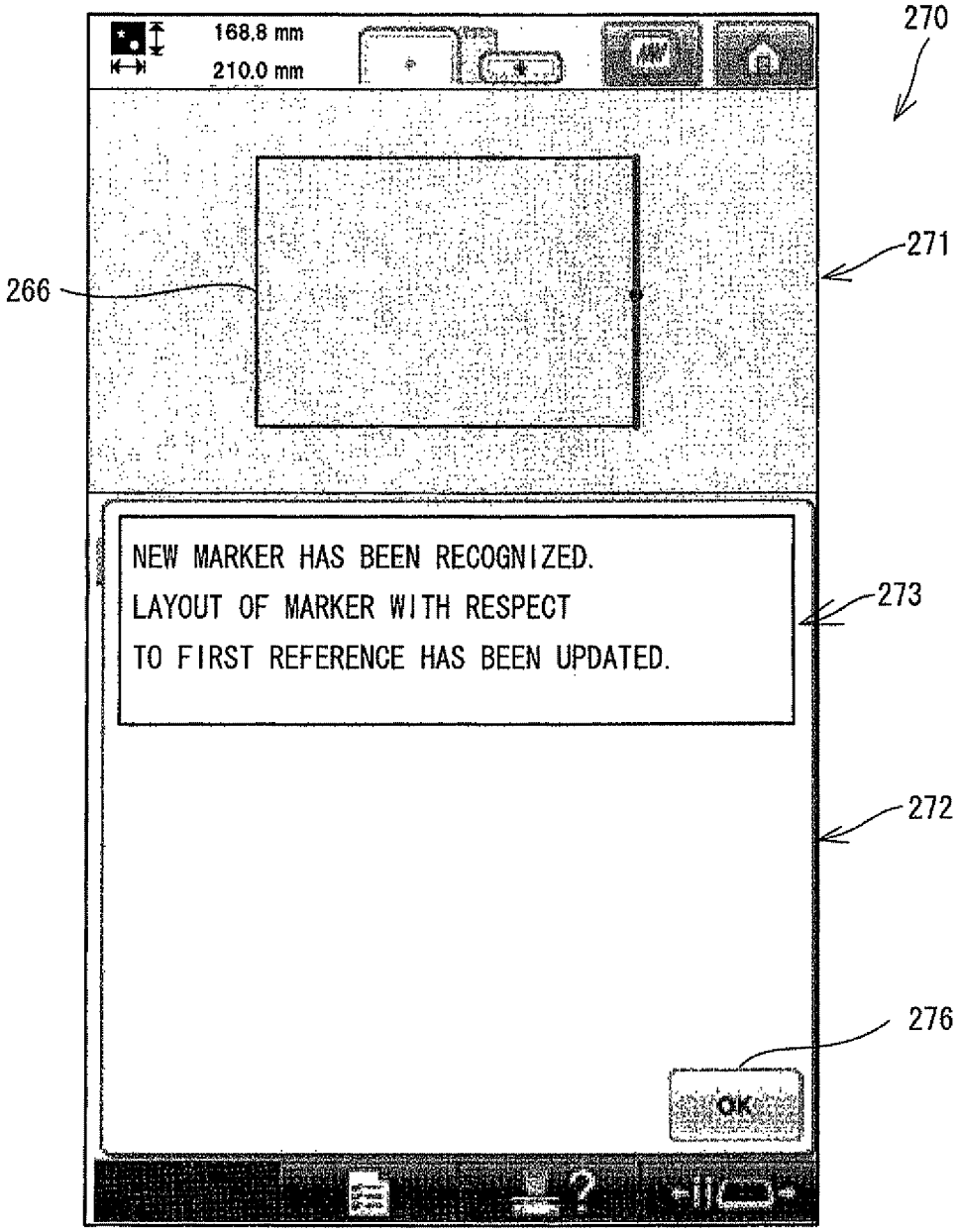
FIG. 18 is an explanatory diagram of a screen 270.

After step S718, the processing returns to step S707. Since the variable M is 2 (yes at step S707), a screen 270 exemplified in FIG. 18 is displayed (step S721). A pattern display column 271, a message 273 indicating that the layout of the marker 110 with respect to the first reference is updated, and an OK key 276 are displayed on the screen 270.

When the OK key 276 is selected, a message that prompts the user to change the holding position of the sewing target object 39 is displayed on the LCD 7 (step S722). After that, the screen 250 is displayed and the processing returns to step S67 of the layout setting processing. After the message is displayed, the user changes the holding position of the sewing target object 39 with respect to the embroidery frame 84, from the temporary holding position shown in the state C in FIG. 12 to the second holding position shown in a state D in FIG. 12. Note that the change of the holding position of the sewing target object 39 is performed in a state in which the markers 110 are attached. In other words, even if the holding position of the sewing target object 39 is changed, the layout of the markers 110 with respect to the sewing target object 39 is not changed. At step S74, it is determined whether the OK key 256 has been selected. When the OK key 256 has not been selected (no at step S74), the processing returns to step S64. When the OK key 256 has been selected (yes at step S74), processing to identify the layout of the reference pattern (the (N−1)-th pattern) in the second holding position is performed based on the layout of the markers 110 (step S76 to step S80). However, unlike the marker detection processing, the whole inside of the embroidery frame 84 is set as the detection target range of the marker 110.

Specifically, first, the image data output from the image sensor 50 is acquired (step S76). Next, the detection processing of the marker 110 is performed taking the whole image represented by the image data acquired at step S76 as a detection target (step S78). The detection of the marker 110 is performed using a known method in a similar manner to step S200. When the marker 110 is detected, for example, the coordinates of the embroidery coordinate system of the first center point 111 and the second center point 112 of the marker 110 are calculated. When the marker 110 is not detected at step S78 (no at step S80), or when the first marker 110 is detected at step S78 (yes at step S80, no at step S82), it is determined whether the whole inside area of the embroidery frame 84 is set as the detection target range (step S84). When there is an area that has not been set as the detection target range (no at step S84), the control signal is output to the drive circuits 131 and 133, and the embroidery frame 84 is moved so that the area that has not been set as the detection target range falls within the image capturing range of the image sensor 50 (step S86). When the whole inside area of the embroidery frame 84 is set as the detection target range (yes at step S84), the message informing that the two markers 110 cannot be detected is displayed on the LCD 7 (step S88). In this case, the user checks whether the two markers 110 are located in the inside area of the embroidery frame 84. After step S86 or step S88, the processing returns to step S76.

When each of the two markers 110 is detected (yes at step S80, yes at step S82), based on the embroidery coordinates of the detected markers 110 and on the layout of the markers 110 with respect to the first reference (the first line segment 227 and the first point 228) in the temporary holding position shown in the state C in FIG. 12, the layout of the markers 110 with respect to the first reference in the second holding position shown in the state D in FIG. 12 is identified (step S90). The identified layout is updated and registered in the RAM 63. Specifically, if the holding position of the sewing target object 39 is changed to the second holding position, the embroidery coordinate system in the second holding position is set. As a result, the embroidery coordinates of the markers 110 in the second holding position can be detected. Further, the embroidery coordinates of the first reference have already been associated and identified with the embroidery coordinates of the markers 110 after the reattachment in the temporary holding position. Therefore, if the embroidery coordinates of the first reference in the temporary holding position are converted to the coordinates of the embroidery coordinate system in the second holding position, the embroidery coordinates of the first reference in the second holding position can be associated with the markers 110. Then, the layout (including the position and angle) of the markers 110 with respect to the first reference in the second holding position can be detected.

Figure 19:
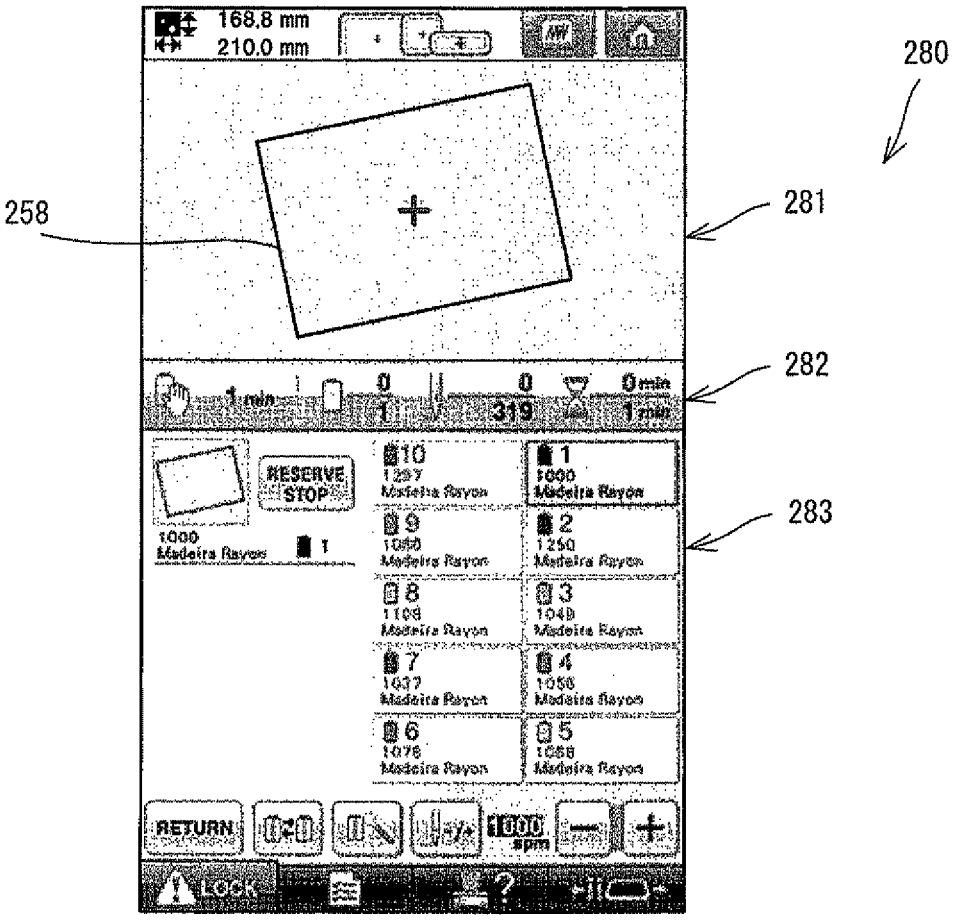
FIG. 19 is an explanatory diagram of a screen 280.

Next, the layout of the next pattern (the N-th pattern) with respect to the sewing target object 39 in the second holding position is set based on the layout of the markers 110 with respect to the first reference in the second holding position, and on the relative layout of the next pattern with respect to the layout of the reference pattern (step S92). Specifically, the layout of the next pattern is set based on the association between the embroidery coordinates of the markers 110 and the embroidery coordinates of the first reference (the first line segment 227 and the first point 228) in the second holding position shown in the state D in FIG. 12, and on the embroidery coordinates of the second reference (the second line segment and the second point). At step S92, the sewing data of the N-th pattern is corrected based on a result of the setting. The result of the setting of the layout of the N-th pattern is displayed on the LCD 7 as shown on a screen 280 in FIG. 19, for example. A pattern display column 281, a sewing information column 282, and a thread color display column 283 are displayed on the screen 280. The pattern display column 281 is similar to the pattern display column 201. The layout of the second pattern 205, shown as a specific example, is represented by the position and angle of the rectangle 258 in the pattern display column 281. A sewing time, the number of thread colors, the number of needle drop points, and an elapsed time from the start of sewing are displayed in the sewing information column 282, as conditions to sew the N-th pattern. The color of the thread supplied to the lower end of the needle bar 31 is displayed in the thread color display column 283. Next, a message "Please peel off the markers" (not shown in the drawings) is displayed on the LCD 7 (step S94). Next, the screen including the sewing start key and the pattern connecting key (which are not shown in the drawings) is displayed on the LCD 7. The layout setting processing is completed and the processing returns to the main processing.

Figure 20:
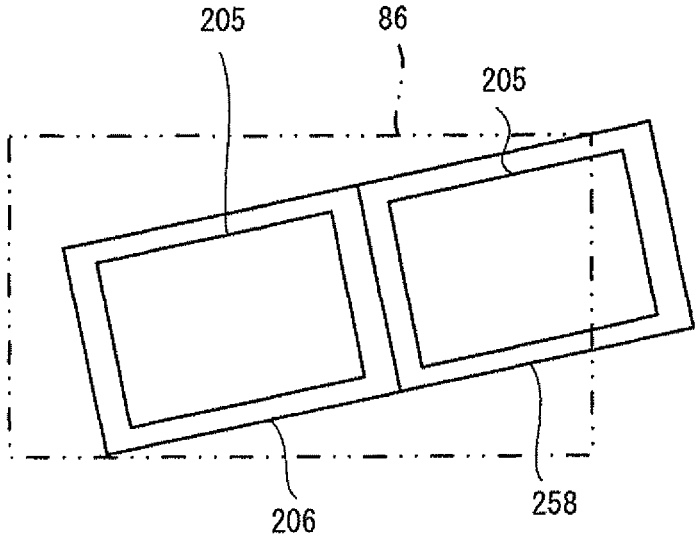
FIG. 20 is an explanatory diagram illustrating a layout of a second pattern 205 represented by a rectangle 258 with respect to a layout of the first pattern 205 represented by the rectangle 206, and a sewable area 86.

In the main processing, subsequent to step S60, the CPU 61 stands by until the pattern connecting key or the sewing start key is selected (no at step S95, no at step S220). When the pattern connecting key is selected (yes at step S95), the above-described processing at step S100 is performed. When the sewing start key is selected (no at step S95, yes at step S220), sewing of the N-th pattern is performed in a similar manner to the processing at step S150 (step S230). In the specific example, the second pattern 205 is sewn in accordance with the layout shown by the rectangle 258 in the pattern display column 281 in FIG. 19. This completes the main processing. According to the main processing, in the specific example, the two patterns 205 are sewn in a range larger than the sewable area 86, which is set with respect to the sewing target object 39, in the first holding position such that the two patterns 205 are respectively arranged in the layout shown by the rectangle 206 and the layout shown by the rectangle 258, as exemplified in FIG. 20.

In the sewing machine 1 of the present embodiment, every time the image data of the markers arranged on the surface of the sewing target object 39 is acquired, the layout of the markers with respect to the first reference is updated and registered. Then, the layout of the next pattern in the second holding position is set based on the layout of the markers with respect to the first reference, and on the relative layout of the next pattern with respect to the layout of the reference pattern. Thus, the operation by the user to identify the layout of the reference pattern in the second holding position is completed only by attaching the markers 110 to the sewing target object 39. Therefore, the operation of the sewing machine 1 is easier as compared to a sewing machine in which the user identifies the layout by visual check. The sewing machine 1 has a higher accuracy in identifying the layout of the reference pattern in the second holding position, as compared to the sewing machine in which the user identifies the layout by visual check. Particularly, in the sewing machine 1 of the present embodiment, the two markers 110 are used to identify the layout of the reference pattern in the second holding position. Therefore, particularly, the relative angle can be identified accurately, as compared to a case in which the single marker 110 is used to identify the layout.

Figure 21:
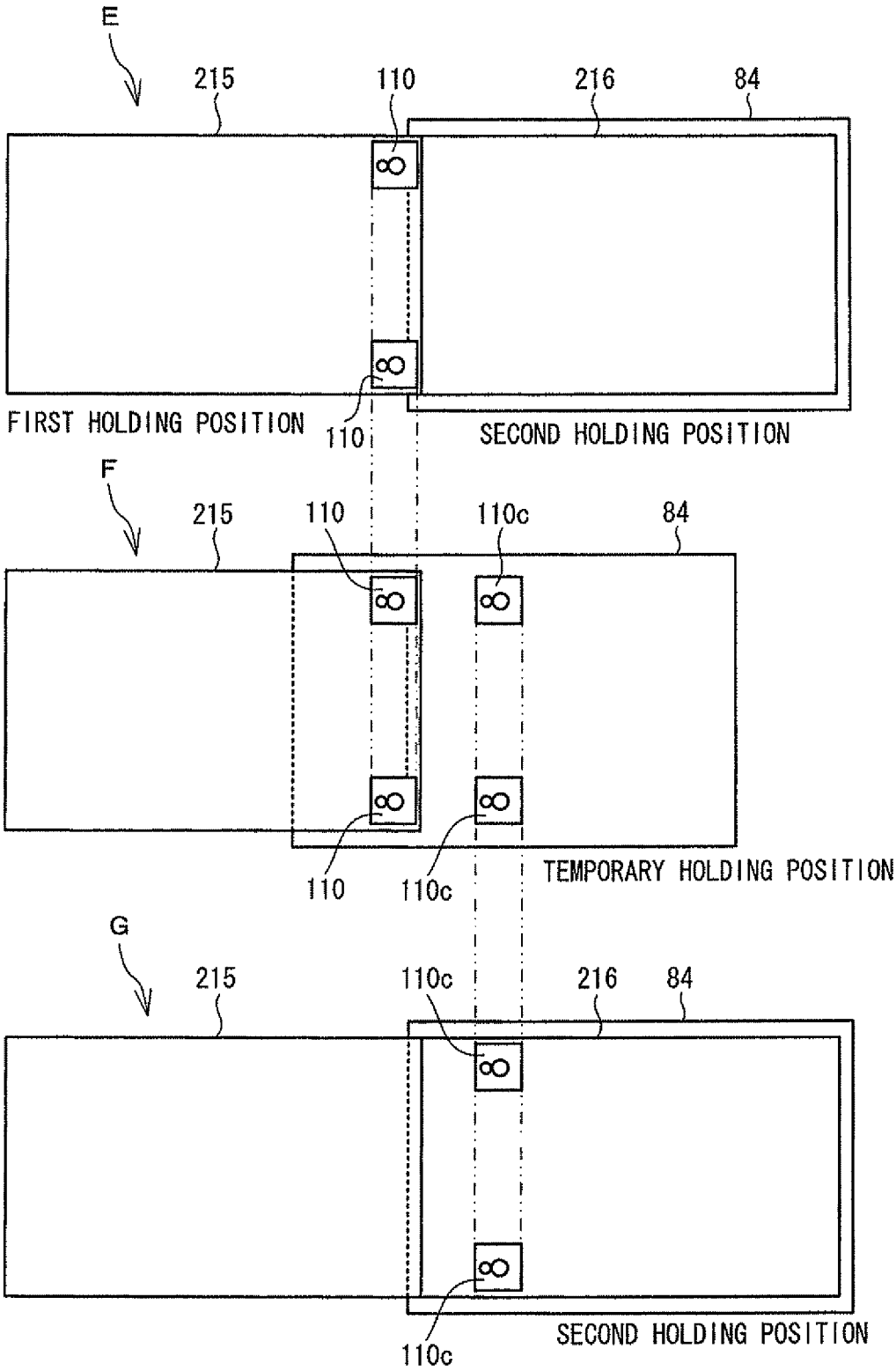
FIG. 21 is a diagram showing an example when two patterns are connected.

When the patterns are connected using markers, it is necessary that the reference pattern and the arranged markers are located within the embroidery frame in the first holding position, and that the next pattern and the arranged markers are located within the embroidery frame in the second holding position. Therefore, when a next pattern 216 and the arranged markers 110 are not located within the embroidery frame 84 in the second holding position, as shown in a state E in FIG. 21, the patterns may not be connected. Even in this type of case, after the layout of the markers 110 is detected in the first holding position shown in the state E in FIG. 21, the holding position is changed to the temporary holding position as shown in a state F in FIG. 21, and the markers 110 are re-attached to positions of markers 110C so that the layout of the markers 110C is detected. Next, the holding position is changed to the second holding position as shown in a state G in FIG. 21. Thus, the next pattern 216 and the markers 110C are arranged within the embroidery frame 84, and it is possible to connect the two patterns.

When a plurality of patterns are sewn in a range larger than the sewable area, the sewing machine 1 can set the layout of the next pattern with respect to the sewing target object 39 in the second holding position so that the relative layout of the next pattern with respect to the layout of the reference pattern is set to the layout specified by the user. The user sets the first reference by selecting the first specifying key and sets the second reference by selecting the second specifying key. With such simple operations, the user can set the relative layout of the next pattern with respect to the layout of the reference pattern.

Figure 14:
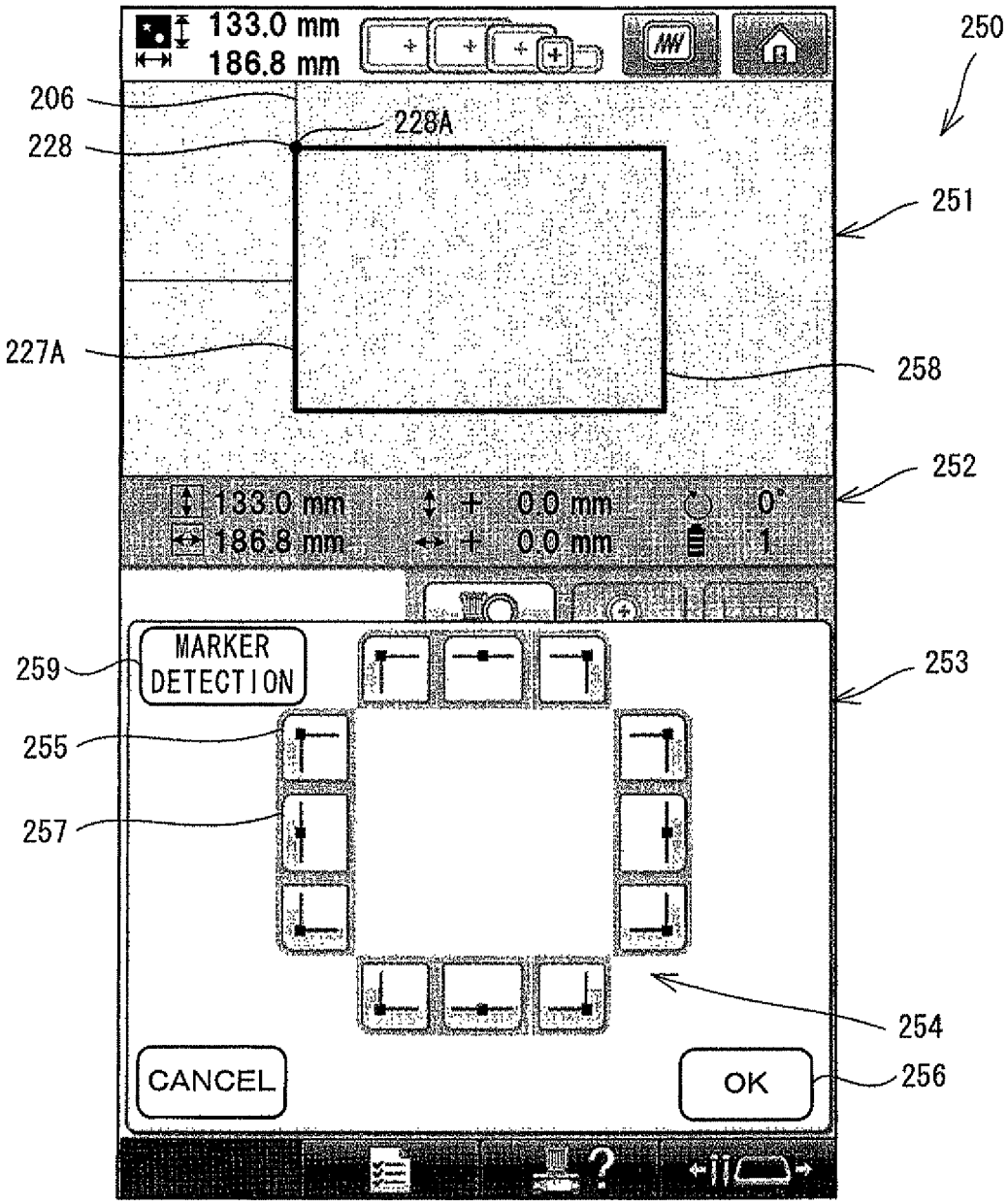
FIG. 14 is an explanatory diagram of a screen 250.

As exemplified in FIG. 14 and FIG. 15, the sewing machine 1 displays the relative layout of the next pattern with respect to the layout of the reference pattern. Therefore, based on the display of the screen, the user can confirm whether the relative layout of the next pattern with respect to the layout of the reference pattern is set as intended by the user. As exemplified by the screen 240 in FIG. 11, the sewing machine 1 displays on the LCD 7 the composite image 244 including the red rectangle 245, which indicates the estimated position to attach the marker 110. Therefore, the sewing machine 1 can prompt the user to arrange one or more of the markers 110 in the estimated layout position. Further, when the holding position of the sewing target object 39 with respect to the embroidery frame 84 is in the first holding position, the sewing machine 1 may perform processing to detect the markers 110 only for the estimated layout position. Therefore, as compared to a case in which the whole range that is in the inside of the embroidery frame 84 is set as the detection target range, the sewing machine 1 can simplify the processing to detect the layout of the markers 110. The estimated layout position is automatically set to the vicinity of the first reference, particularly, to the vicinity of both the ends of the first line segment. In the present embodiment, the relative layout of the second reference with respect to the first reference is set as described above. Since the estimated layout position is set as described above, the user can easily set the second holding position such that the markers 110 are arranged within the image capturing range. As described above, the sewing machine 1 can sew the reference pattern and the next pattern on the sewing target object 39 such that the relative layout of the next pattern with respect to the layout of the reference pattern is the layout specified by the user.

Next, main processing that is performed by the sewing machine 1 according to the second embodiment will be explained. Although the main processing of the second embodiment is not shown in the drawings, the layout setting processing at step S60 is different from that in the main processing of the first embodiment shown in FIG. 5, and the processing other than the layout setting processing is the same. Hereinafter, an explanation of the processing that is the same as the main processing of the first embodiment is omitted, and the processing at step S60 that is different from that of the main processing of the first embodiment will be explained with reference to FIG. 22 and FIG. 23. The main processing of the second embodiment is performed by the CPU 61 in accordance with the main program stored in the ROM 62.

Figure 13:
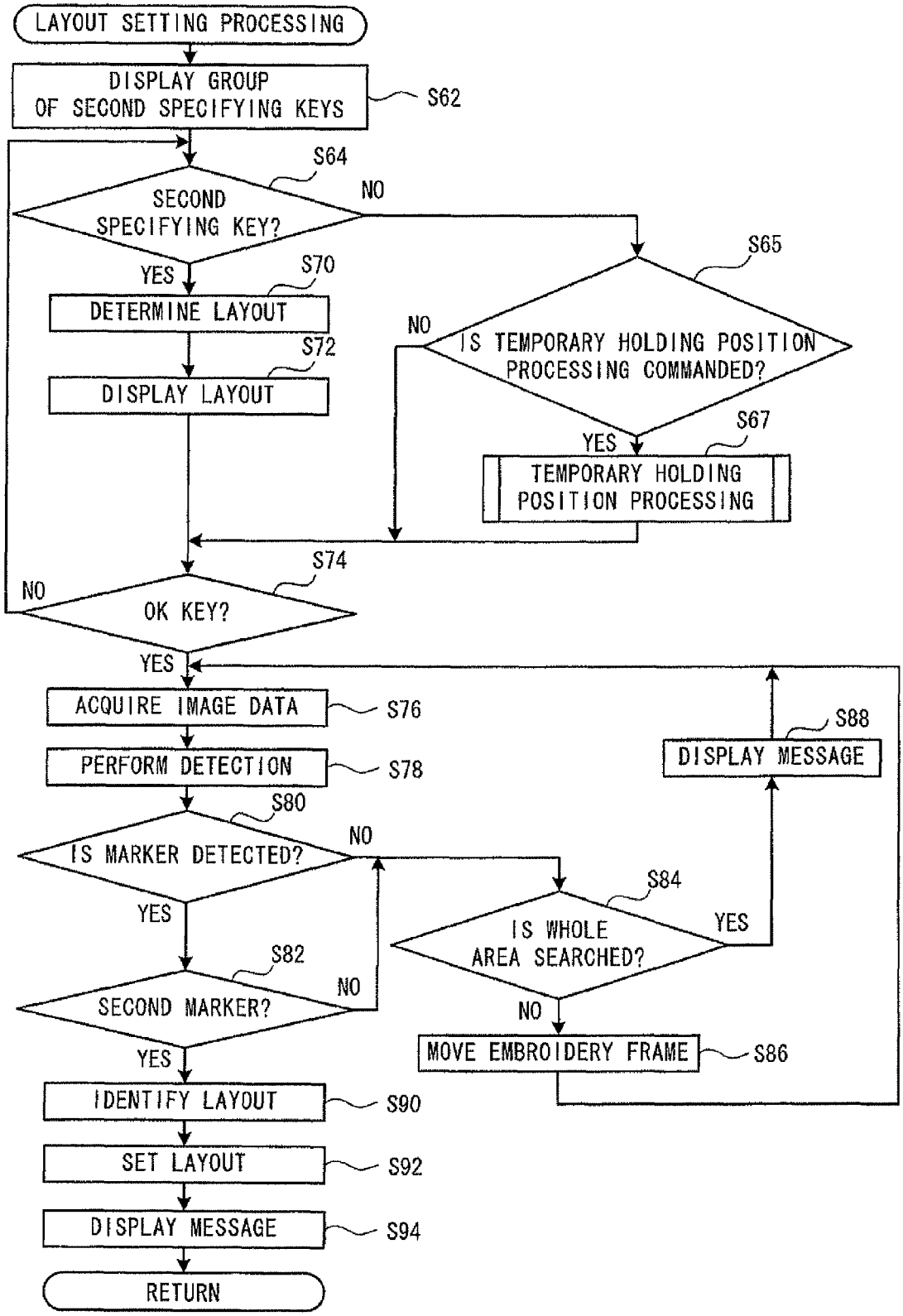
FIG. 13 is a flowchart of layout setting processing according to a first embodiment.
Figure 22:
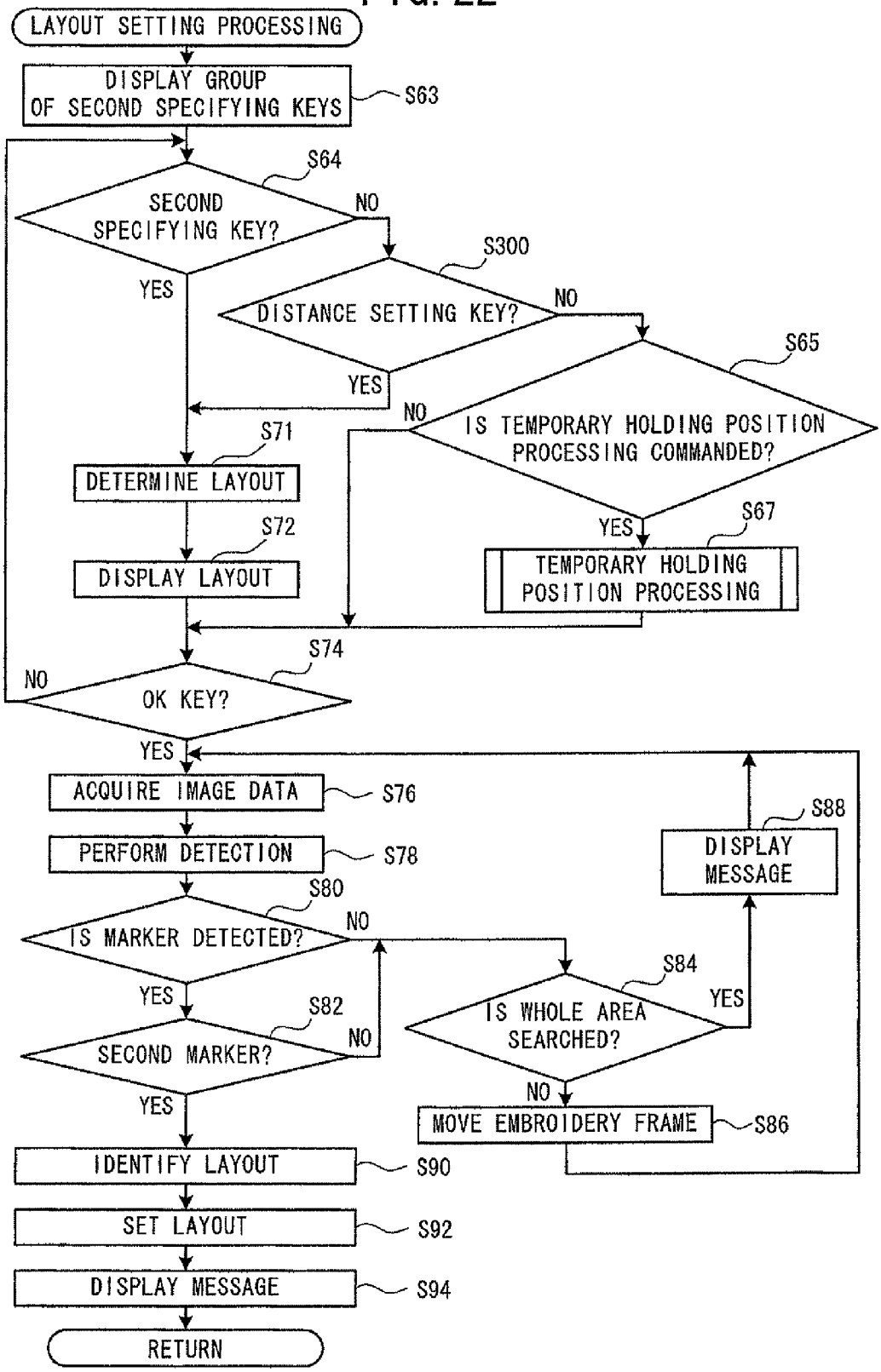
FIG. 22 is a flowchart of layout setting processing according to a second embodiment.

In the layout setting processing of the second embodiment shown in FIG. 22, the processing that is performed in the same manner as in the layout setting processing of the first embodiment shown in FIG. 13 is assigned the same step number. The layout setting processing of the second embodiment is different from the layout setting processing of the first embodiment shown in FIG. 13 in that step S300 is performed, step S63 is performed in place of step S62, and step S71 is performed in place of step S70. An explanation of the processing that is the same as in the first embodiment is omitted, and hereinafter, the processing at step S63, step S300 and step S71 that is different from the first embodiment will be explained using a similar specific example to that in the first embodiment.

Figure 23:
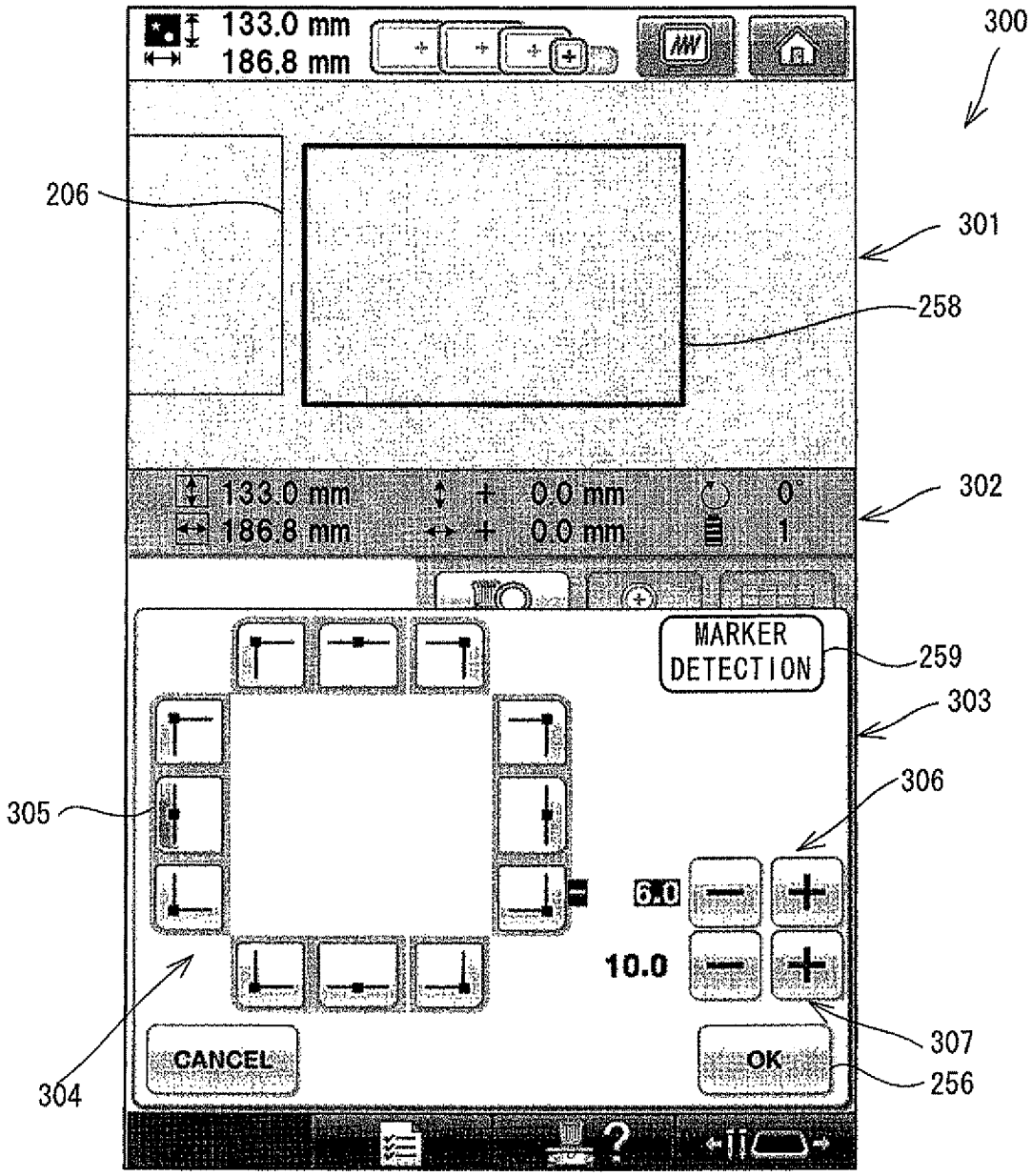
FIG. 23 is an explanatory diagram of a screen 300.

In the second embodiment, a numerical value can be used to set the relative position of the second reference with respect to the first reference. At step S63, for example, a screen 300 exemplified in FIG. 23 is displayed. A pattern display column 301, a pattern information column 302, and a layout specification column 303 are displayed on the screen 300. The pattern display column 301 is similar to the pattern display column 201 and the pattern information column 302 is similar to the pattern information column 202. A group of second specifying keys 304, Y-axis direction distance setting keys 306, X-axis direction distance setting keys 307, the OK key 256, and the marker detection key 259 are displayed in the layout specification column 303. The group of second specifying keys 304 is similar to the group of second specifying keys 254. The Y-axis direction distance setting keys 306 are keys to specify a relative position, in the Y-axis direction of the embroidery coordinate system, of the second reference with respect to the first reference, using a numerical value in units of mm. The X-axis direction distance setting keys 307 are keys to specify a relative position, in the X-axis direction of the embroidery coordinate system, of the second reference with respect to the first reference, using a numerical value in units of mm.

After step S63, it is determined whether one of the second specifying keys is selected from among the group of second specifying keys 304. When one of the second specifying keys is selected (yes at step S64), the processing proceeds to step S71. The processing at step S71 is the same as the processing at step S70. On the other hand, when none of the second specifying keys is selected (no at step S64), it is determined whether one of the Y-axis direction distance setting keys 306 and the X-axis direction distance setting keys 307 is selected (step S300).

When the Y-axis direction setting key 306 or the X-axis direction setting key 307 is selected (yes at step S300), the relative layout of the next pattern (the N-th pattern) with respect to the layout of the reference pattern ((N−1)-th pattern) is determined at step S71 in the following manner. The relative layout of the next pattern with respect to the layout of the reference pattern is set based on a position that is moved, by a distance specified by the distance setting key, from an initial position of the second reference with respect to the first reference. The initial position of the second reference with respect to the first reference is a position that is set in the same manner as at step S70 when one of the second specifying keys included in the group of second specifying keys 304 is selected. The pattern display column 301 displays the relative layout of the rectangle 258 with respect to the layout of the rectangle 206 when the distance setting keys 306 and 307 are selected after a second specifying key 305 is selected. More specifically, the relative layout of the rectangle 258 with respect to the layout of the rectangle 206 is displayed for the case where the second reference is relatively moved from the above-described initial position by +10.0 mm in the X-axis direction and by −6.0 mm in the Y-axis direction, according to the numerical value specified using the Y-axis direction distance setting key 306 and the X-axis direction distance setting key 307. Note that the rectangle 206 represents the first pattern 205 and the rectangle 258 represents the second pattern 205. On the other hand, when none of the Y-axis direction distance setting keys 306 and the X-axis direction distance setting keys 307 is selected (no at step S300), the marker detection key 259 is selected, and it is determined whether the temporary holding position processing is commanded (step S65). When the temporary holding position processing is not commanded (no at step S65), the processing proceeds to step S74. On the other hand, when the temporary holding position processing is commanded (yes at step S65), the processing proceeds to step S67 and the temporary holding position processing is performed.

Figure 24:
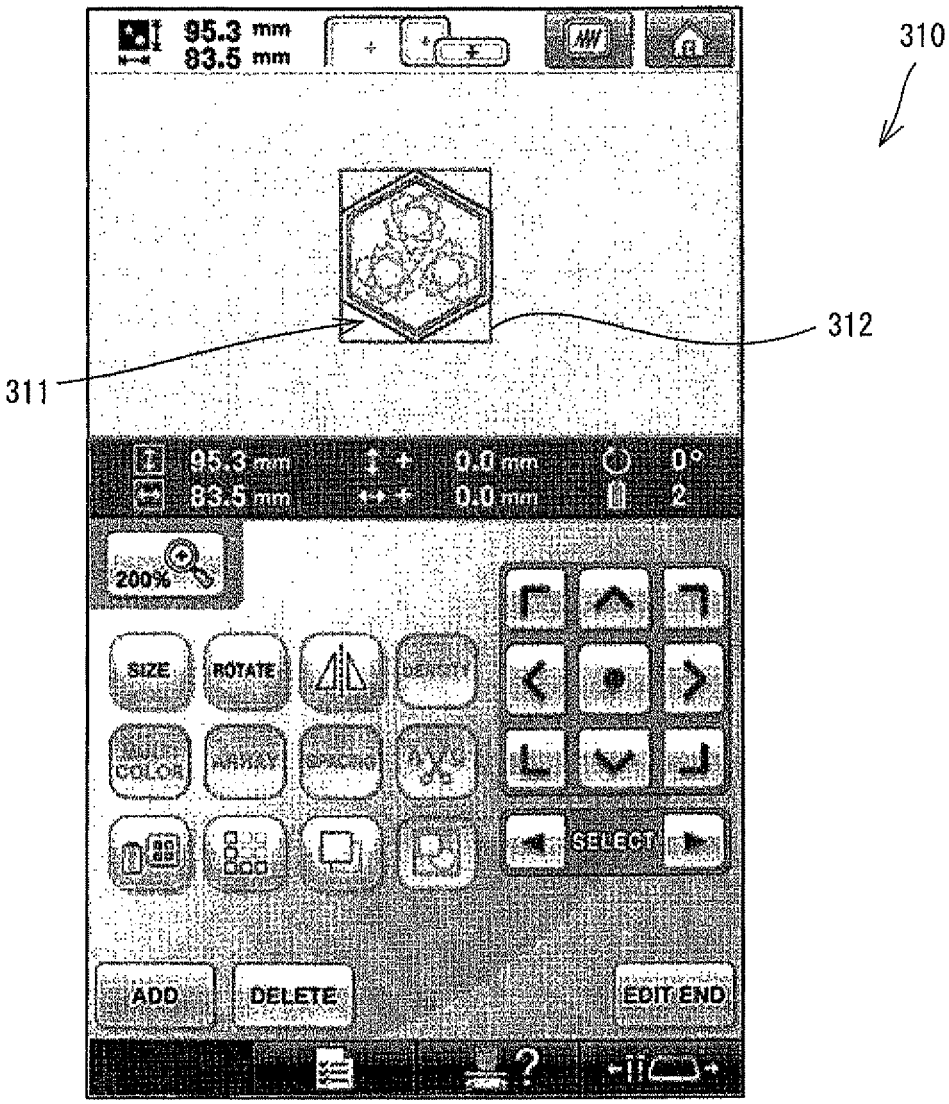
FIG. 24 is an explanatory diagram of a screen 310.
Figure 25:
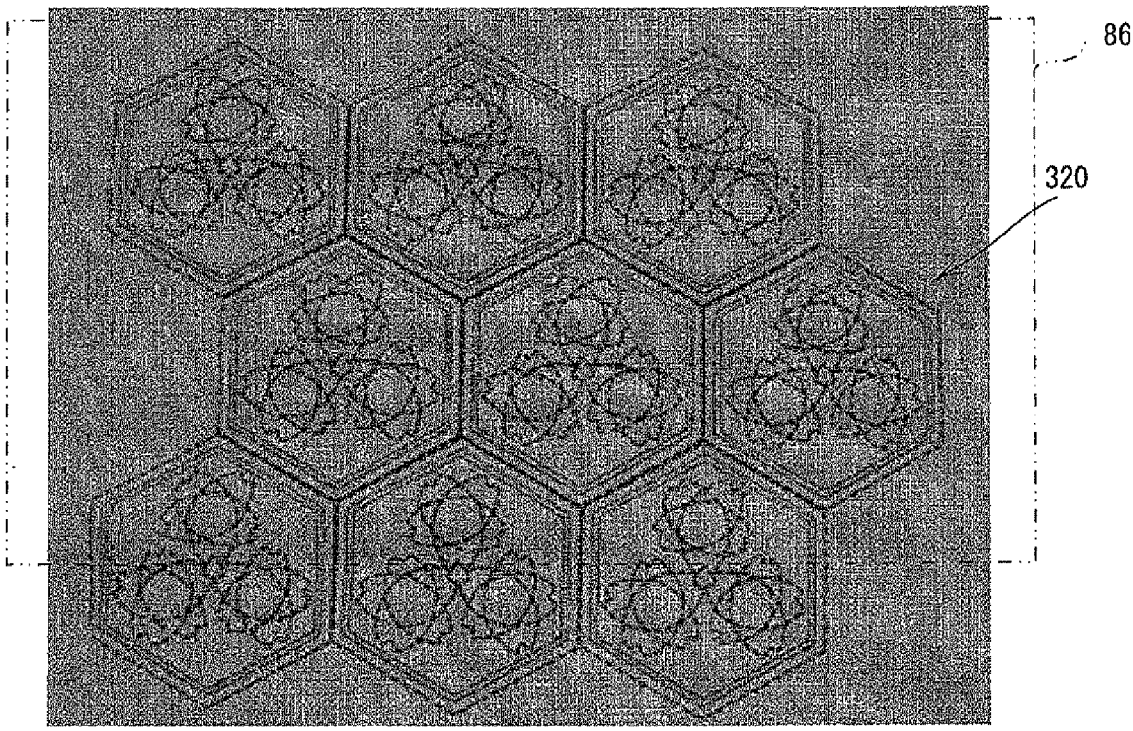
FIG. 25 is an explanatory diagram of a group of patterns 320 and the sewable area 86.

In the sewing machine 1 of the above-described second embodiment, the CPU 61 that performs step S300 functions as a "numerical value acquisition portion" of the present invention. The CPU 61 that performs step S71 functions as a "layout determination portion" of the present disclosure. According to the sewing machine 1 of the second embodiment, the user can set the relative layout of the next pattern with respect to the layout of the reference pattern, by a simple operation of setting a numerical value. The main processing of the second embodiment is used, for example, when a plurality of regular hexagonal patterns 311, an example of which is shown on a screen 310 in FIG. 24, are sewn in a range larger than the sewable area 86. The user performs the main processing when sewing patterns before and after changing the holding position of the sewing target object 39 with respect to the embroidery frame 84. In the main processing, the first reference and the second reference are set for a rectangle 312 that represents a range of each of the patterns 311, and the relative position of the second reference with respect to the first reference is adjusted. As a result, as exemplified in FIG. 25, a group of patterns 320 including the nine patterns 311 can be sewn in an area larger than the sewable area 86.

The sewing machine of the present disclosure is not limited to the above-described embodiments, and various modifications may be made without departing from the spirit and scope of the present disclosure. For example, modifications from (A) to (E) described below may be made as appropriate.

(A) The configuration of the sewing machine 1 may be changed as appropriate if necessary. For example, the present disclosure may be applied to an industrial-use sewing machine and a home-use sewing machine. As another example, the type and layout of the image sensor 50 may be changed as appropriate. For example, the image sensor 50 may be an imaging device other than the CMOS image sensor, such as a CCD camera.

(B) It is sufficient if the layout of the reference pattern includes at least one of the position and the angle of the reference pattern. Similarly, it is sufficient if the layout of the next pattern includes at least one of the position and the angle of the next pattern.

(C) The first reference may be a reference which is specified by the user, and which includes one of the first line segment and the first point that are included in the first graphic that represents a range in which the reference pattern is sewn. Similarly, the second reference may be a reference which is specified by the user, and which includes one of the second line segment and the second point that are included in the second graphic that represents a range in which the next pattern is sewn. It is sufficient if the first graphic is a graphic that represents the range in which the reference pattern is sewn. The first graphic may be, for example, one of a circle, an ellipse, and a polygon in which the reference pattern can be arranged, as well as the smallest rectangle in which the reference pattern can be arranged. Further, the first graphic may be a contour of the reference pattern. Similarly to the first graphic, the second graphic may be a graphic other than the smallest rectangle in which the next pattern can be arranged. It is sufficient if the first point is a point included in the first graphic. The first point may be a chosen point on the first line segment, or may be a point that is not located on the first line segment. Similarly to the first point, it is sufficient if the second point is a point included in the second graphic.

(D) The number of the markers 110 used in the main processing can be changed as appropriate. When the layout of the reference pattern is identified based on a plurality of the markers 110, the layout of the reference pattern, particularly, an inclination of the reference pattern can be accurately identified, as compared to a case in which the layout of the reference pattern is identified based on the single marker 110. The layout of the markers 110 detected based on the image data may be at least one of the position and the angle of the markers 100. The configuration of the markers 110 may be changed as appropriate. The configuration of the markers 110 includes, for example, a marker size, a material, a design, and a color. The reference (the first center point 111 of the marker 110 in the above-described embodiments) to identify the layout of the markers 110, and its calculation method may be changed as appropriate, taking the configuration etc. of the markers 110 into consideration.

(E) The main processing may be changed as appropriate. For example, the following modifications may be made. (E-1) The method for determining the relative layout of the next pattern with respect to the layout of the reference pattern may be changed as appropriate. For example, although in the above-described embodiments, the first reference is specified using the first specifying key and the second reference is specified using the second specifying key, the present disclosure is not limited to this. More specifically, the first reference (the second reference) may be freely specified by the user from among the line segments and points included in the first graphic (the second graphic). As another example, the layout of the second reference with respect to the first reference is not limited to the case described in the above-described embodiments, and may be changed as appropriate. As another example, a numerical value may be used to specify the angle of the second line segment included in the second reference, with respect to the first line segment included in the first reference. By doing this, the relative layout of the next pattern can be inclined at a desired angle with respect to the layout of the reference pattern. As another example, references corresponding to the first reference and the second reference may be automatically set, and the user may numerically set at least one of a positional relationship and an angular relationship between the set references. Examples of the references corresponding to the first reference and the second reference include a representative point of the first graphic (the second graphic) and a representative line segment of the first graphic (the second graphic). Examples of the representative point of the first graphic (the second graphic) include the center point and the end point of the graphic. Examples of the representative line segment of the first graphic (the second graphic) include a diagonal line of the graphic and one of the sides of the graphic.

(E-2) A timing at which the processing is performed to determine the relative layout of the next pattern with respect to the layout of the reference pattern may be changed as appropriate. For example, a timing at which each of the first reference and the second reference is acquired may be changed as appropriate. More specifically, after the reference pattern is sewn, the processing to acquire the first reference may be performed.

(E-3) The processing at step S72 in FIG. 13 may be omitted as appropriate. Similarly, the processing at step S192 in FIG. 9 may be omitted as appropriate. When the processing at step S192 in FIG. 9 is performed, the estimated layout position may be a position that is inside the embroidery frame 84 and that falls within the image capturing range of the image sensor 50, in the first holding position and the second holding position. The estimated layout position may be set by the user, for example. As another example, the method for displaying the estimated layout position may be changed as appropriate. Specifically, an estimated position of the center of the marker may be displayed as a pattern, such as a star. Alternatively, an estimated range in which the whole marker can be arranged may be displayed as a graphic, such as a circle, an ellipse, or a polygon.

(E-4) Processing that edits the N-th pattern may be performed between step S40 and step S60 in FIG. 5. Examples of the processing that edits the N-th pattern include a size change, rotation, and inversion of the pattern. Further, when the pattern is rotated in the processing that edits the N-th pattern, the graphic that represents the range of the rotated pattern may be reset.

What is claimed is:

1. A sewing machine comprising:

an image capturing device that captures a marker arranged on a surface of a sewing target object held by an embroidery frame;

an acquisition portion that acquires image data of the marker captured by the image capturing device;

a layout determination portion that, if it is assumed that a reference pattern is a pattern that is sewn when a holding position of the sewing target object with respect to the embroidery frame is a first holding position and it is also assumed that a next pattern is a pattern that is sewn subsequently to the reference pattern and that is sewn when the holding position is a second holding position that is different from the first holding position, determines a relative layout including at least one of a position and an angle of the next pattern with respect to a layout including at least one of a position and an angle of the reference pattern;

a layout detection portion that, based on the image data acquired by the acquisition portion, detects a layout including at least one of a position and an angle of the marker with respect to the layout of the reference pattern;

a storage device that stores the layout of the marker as layout information;

a registration portion that registers, in the storage device, information relating to the layout including at least one of the position and the angle of the marker with respect to the layout of the reference pattern that is detected by the layout detection portion, the information being registered as storage information;

an update portion that updates the storage information stored in the storage device when the layout including at least one of the position and the angle of the marker with respect to the layout of the reference pattern is newly detected by the layout detection portion; and a setting portion that, when the storage information stored in the storage device is information relating to the marker captured in the second holding position, sets a layout including at least one of a position and an angle of the next pattern with respect to the sewing target object in the second holding position, based on the storage information and on the relative layout of the next pattern with respect to the layout of the reference pattern that is determined by the layout determination portion.

2. The sewing machine according to claim 1, further comprising:

a reception portion that receives information indicating that the marker is re-attached;

wherein when the information is received by the reception portion, the layout detection portion detects a layout of the re-attached marker with respect to the marker before the reattachment.

3. The sewing machine according to claim 1, further comprising:

a first reference acquisition portion that acquires a first reference which is a reference specified by a user and which is a reference including one of a first line segment and a first point that are included in a first graphic that represents a range in which the reference pattern is sewn; and a second reference acquisition portion that acquires a second reference which is a reference specified by the user and which is a reference including a second line segment and a second point that are included in a second graphic that represent a range in which the next pattern is sewn;

wherein the layout determination portion determines the relative layout of the next pattern with respect to the layout of the reference pattern, based on the first reference acquired by the first reference acquisition portion and on the second reference acquired by the second reference acquisition portion.

4. The sewing machine according to claim 3, wherein the first reference acquisition portion acquires the first reference based on a first specifying key that is specified by the user from among a plurality of first specifying keys, in which the first line segment and the first point on the first line segment are combined, the second reference acquisition portion acquires the second reference based on a second specifying key that is specified by the user from among a plurality of second specifying keys, in which the second line segment and the second point on the second line segment are combined, and the layout determination portion determines that the relative layout of the next pattern with respect to the layout of the reference pattern is a layout in which an extending direction of the first line segment represented by the first specifying key acquired by the first reference acquisition portion overlaps with the second line segment represented by the second specifying key acquired by the second reference acquisition portion, and also in which the first point represented by the first specifying key overlaps with the second point represented by the second specifying key.

5. The sewing machine according to claim 1, further comprising:

a numerical value acquisition portion that acquires a numerical value which is specified by the user and which identifies the relative layout of the next pattern with respect to the layout of the reference pattern;

wherein the layout determination portion determines the relative layout of the next pattern with respect to the layout of the reference pattern, based on the numerical value acquired by the numerical value acquisition portion.

6. The sewing machine according to claim 1, further comprising:

a first display portion that displays, on a screen, the relative layout of the next pattern with respect to the layout of the reference pattern that is determined by the layout determination portion.

7. The sewing machine according to claim 1, further comprising:

a second display portion that displays, on a screen, an estimated layout position of the at least one marker.

8. The sewing machine according to claim 1, further comprising:

a movement device that has a function that causes the embroidery frame that holds the sewing target object to move;

a sewing device that sews a pattern on the sewing target object by vertically moving a needle bar having a lower end to which a needle is attached;

a first sewing control portion that controls the movement device and the sewing device such that the reference pattern is sewn on the sewing target object that is held by the embroidery frame in a state in which the holding position is the first holding position; and a second sewing control portion that controls the movement device and the sewing device such that the next pattern is sewn on the sewing target object that is held in a state in which the holding position is the second holding position, in accordance with the layout of the next pattern set by the setting portion.

9. A computer program product stored on a non-transitory computer-readable medium, comprising instructions for causing a computer of a sewing machine to execute the steps of:

capturing a marker arranged on a surface of a sewing target object held by an embroidery frame;

acquiring image data of the captured marker;

determining, if it is assumed that a reference pattern is a pattern that is sewn when a holding position of the sewing target object with respect to the embroidery frame is a first holding position and it is also assumed that a next pattern is a pattern that is sewn subsequently to the reference pattern and that is sewn when the holding position is a second holding position that is different from the first holding position, a relative layout including at least one of a position and an angle of the next pattern with respect to a layout including at least one of a position and an angle of the reference pattern;

detecting, based on the acquired image data, a layout including at least one of a position and an angle of the marker with respect to the layout of the reference pattern;

storing, as storage information, information relating to the detected layout including at least one of the position and the angle of the marker with respect to the layout of the reference pattern;

updating the stored storage information when the layout including at least one of the position and the angle of the marker with respect to the layout of the reference pattern is newly detected; and setting, when the stored storage information is information relating to the marker captured in the second holding position, a layout including at least one of a position and an angle of the next pattern with respect to the sewing target object in the second holding position, based on the storage information and on the determined relative layout of the next pattern with respect to the layout of the reference pattern.

10. The computer program product according to claim 9, wherein when information indicating that the marker is re-attached is received, a layout of the re-attached marker with respect to the marker before the reattachment is detected.

11. The computer program product according to claim 9, further comprising the steps of:

acquiring a first reference which is a reference specified by a user and which is a reference including one of a first line segment and a first point that are included in a first graphic that represents a range in which the reference pattern is sewn; and acquiring a second reference which is a reference specified by the user and which is a reference including a second line segment and a second point that are included in a second graphic that represent a range in which the next pattern is sewn, wherein the relative layout of the next pattern with respect to the layout of the reference pattern is determined based on the acquired first reference and the acquired second reference.

12. The computer program product according to claim 11, wherein the first reference is acquired based on a first specifying key that is specified by the user from among a plurality of first specifying keys, in which the first line segment and the first point on the first line segment are combined, the second reference is acquired based on a second specifying key that is specified by the user from among a plurality of second specifying keys, in which the second line segment and the second point on the second line segment are combined, and the relative layout of the next pattern with respect to the layout of the reference pattern is arranged such that an extending direction of the first line segment represented by the specified first specifying key overlaps with the second line segment represented by the specified second specifying key, and also such that the first point represented by the first specifying key overlaps with the second point represented by the second specifying key.

13. The computer program product according claim 9, further comprising the steps of:

acquiring a numerical value which is specified by the user and which identifies the relative layout of the next pattern with respect to the layout of the reference pattern, and wherein the relative layout of the next pattern with respect to the layout of the reference pattern is determined based on the acquired numerical value.

14. The computer program product according to claim 9, further comprising the steps of:

displaying the determined relative layout of the next pattern with respect to the layout of the reference pattern on a screen.

15. The computer program product according to claim 9, further comprising the steps of:

displaying an estimated layout position of the at least one marker on a screen.

16. The computer program product according to claim 9, further comprising the steps of:

sewing the reference pattern on the sewing target object that is held by the embroidery frame in a state in which the holding position is the first holding position, and sewing, in accordance with the set layout of the next pattern, the next pattern on the sewing target object that is held in a state in which the holding position is the second holding position.

* * * * *